US007105784B2

(12) United States Patent
Kikuchi et al.

(10) Patent No.: US 7,105,784 B2
(45) Date of Patent: Sep. 12, 2006

(54) FIXING DEVICE

(75) Inventors: Kazuhiko Kikuchi, Yokohama (JP); Akihiro Wasai, Mishima (JP); Osamu Takagi, Tokyo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/807,428

(22) Filed: Mar. 24, 2004

(65) Prior Publication Data

US 2004/0238531 A1 Dec. 2, 2004

(30) Foreign Application Priority Data

| | | |
|---|---|---|
| Mar. 24, 2003 | (JP) | 2003-081178 |
| Mar. 24, 2003 | (JP) | 2003-081179 |
| Mar. 24, 2003 | (JP) | 2003-081180 |
| Mar. 25, 2003 | (JP) | 2003-082918 |
| Mar. 25, 2003 | (JP) | 2003-083654 |
| Mar. 25, 2003 | (JP) | 2003-083783 |

(51) Int. Cl.
*H05B 6/14* (2006.01)
*H05B 6/12* (2006.01)

(52) U.S. Cl. ..... 219/619; 219/625

(58) Field of Classification Search ..... 219/619, 219/618, 620, 621, 622, 623, 625, 624, 469, 219/470; 399/328, 330, 334
See application file for complete search history.

(56) References Cited

U.S. PATENT DOCUMENTS

| | | | | |
|---|---|---|---|---|
| 5,970,592 | A * | 10/1999 | Feldhoff et al. | 28/240 |
| 6,337,969 | B1 | 1/2002 | Takagi et al. | |
| 6,415,128 | B1 | 7/2002 | Takagi et al. | |
| 6,522,846 | B1 | 2/2003 | Kinouchi et al. | |
| 6,725,000 | B1 * | 4/2004 | Takagi et al. | 399/69 |
| 6,753,515 | B1 * | 6/2004 | Miyahara et al. | 219/619 |
| 6,807,386 | B1 * | 10/2004 | Yasui et al. | 399/69 |
| 6,868,250 | B1 * | 3/2005 | Takagi et al. | 399/328 |
| 6,933,479 | B1 * | 8/2005 | Tanaka et al. | 219/619 |
| 2002/0031381 | A1 | 3/2002 | Miyahara et al. | |

FOREIGN PATENT DOCUMENTS

| | | |
|---|---|---|
| JP | 2001-312165 A | 11/2001 |
| JP | 2001-319763 A | 11/2001 |

OTHER PUBLICATIONS

U.S. Appl. No. 10/154,970, filed May 28, 2002, Takagi et al.
U.S. Appl. No. 10/290,296, filed Nov. 8, 2002, Kinouchi et al.
U.S. Appl. No. 10/807,366, filed Mar. 24, 2004, Wasai et al.
U.S. Appl. No. 10/806,392, filed Mar. 23, 2004, Takagi et al.
U.S. Appl. No. 10/445,210, filed May 27, 2003, Kinouchi et al.

(Continued)

*Primary Examiner*—Daniel Robinson
(74) *Attorney, Agent, or Firm*—Foley & Lardner LLP

(57) ABSTRACT

In a fixing device according to this invention, a coil bobbin around which coils are formed into a predetermined shape is formed at an induction heating portion including a plurality of coils. To minimize the axial temperature difference of a heating roller, the coil bobbin has a shape with which the interval between coils is held at a predetermined interval.

18 Claims, 15 Drawing Sheets

OTHER PUBLICATIONS

U.S. Appl. No. 10/126,618, filed Apr. 22, 2002, Kikuchi et al.
U.S. Appl. No. 10/872,472, filed Jun. 22, 2004, Kinouchi et al.
U.S. Appl. No. 10/455,419, filed Jun. 6, 2003, Takagi et al.
U.S. Appl. No. 10/143,909, filed May 14, 2002, Kinouchi et al.
U.S. Appl. No. 10/391,621, filed Mar. 20, 2003, Wasai.

* cited by examiner

FIXING DEVICE

CROSS-REFERENCE TO RELATED APPLICATIONS

This application is based upon and claims the benefit of priority from prior Japanese Patent Applications No. 2003-081178, filed Mar. 24, 2003; No. 2003-081179, filed Mar. 24, 2003; No. 2003-081180, filed Mar. 24, 2003; No. 2003-082918, filed Mar. 25, 2003; No. 2003-083654, filed Mar. 25, 2003; and No. 2003-083783, filed Mar. 25, 2003, the entire contents of all of which are incorporated herein by reference.

BACKGROUND OF THE INVENTION

1. Field of the Invention

The present invention relates to a fixing device which is mounted in an image forming apparatus such as a copying machine or printer and fixes a developer image on a paper sheet.

2. Description of the Related Art

Conventionally, an image forming apparatus such as an electrophotographic copying machine utilizing a digital technique comprises a fixing device which fixes a developer image onto a paper sheet by heating in a press state.

In recent years, a short warming-up time becomes a technical issue as an energy-saving technique. The measure is to decrease the diameter of the heating roller.

However, a small-diameter heating roller decreases the heat capacity, and it becomes difficult to keep the temperature distribution uniform on the heating roller. For example, an induction heating fixing device may generate a nonuniform temperature distribution on the heating roller unless power per unit area to the heating roller heated by a coil is set to a desired value. The fixing device used in an image forming apparatus may use paper sheets of various sizes, and the coil must be so designed as to set the temperature distribution to a desired one on the heating roller regardless of a paper sheet of any size. Otherwise, the fixing temperature for various paper sheets cannot be kept uniform.

BRIEF SUMMARY OF THE INVENTION

According to an aspect of the present invention, there is provided a fixing device:

induction heating means having coil bobbins each wound with a wire which forms a coil, and a holding member which holds the plurality of coil bobbins at predetermined positions; and a target heating member which generates heat by an eddy current generated upon a change in a magnetic field generated by the coil of the induction heating means, wherein the coil bobbin has a shape with which an interval between coils wound around adjacent coil bobbins is held at a predetermined interval in a state in which the coil bobbin is held by the holding member.

According to another aspect of the present invention, there is provided a fixing device comprising:

a holding body whose outer surface is wound with a coil which generates a magnetic field by supplying a voltage and a current at a predetermined frequency;

a heating member which has a hollow cylindrical shape or an endless belt shape and is so positioned as to generate an eddy current corresponding to the magnetic field provided by the coil;

a flange which is arranged at a predetermined portion on the outer surface of the holding body and keeps a distance between the coil and the heating member constant;

a power supply device which supplies a voltage and a current of a predetermined frequency to the coil; and a press member which is so arranged as to hold a predetermined pressure between the press member and the heating member.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Preferred embodiments of the present invention will be described below with reference to the several views of the accompanying drawing.

Figure 1:
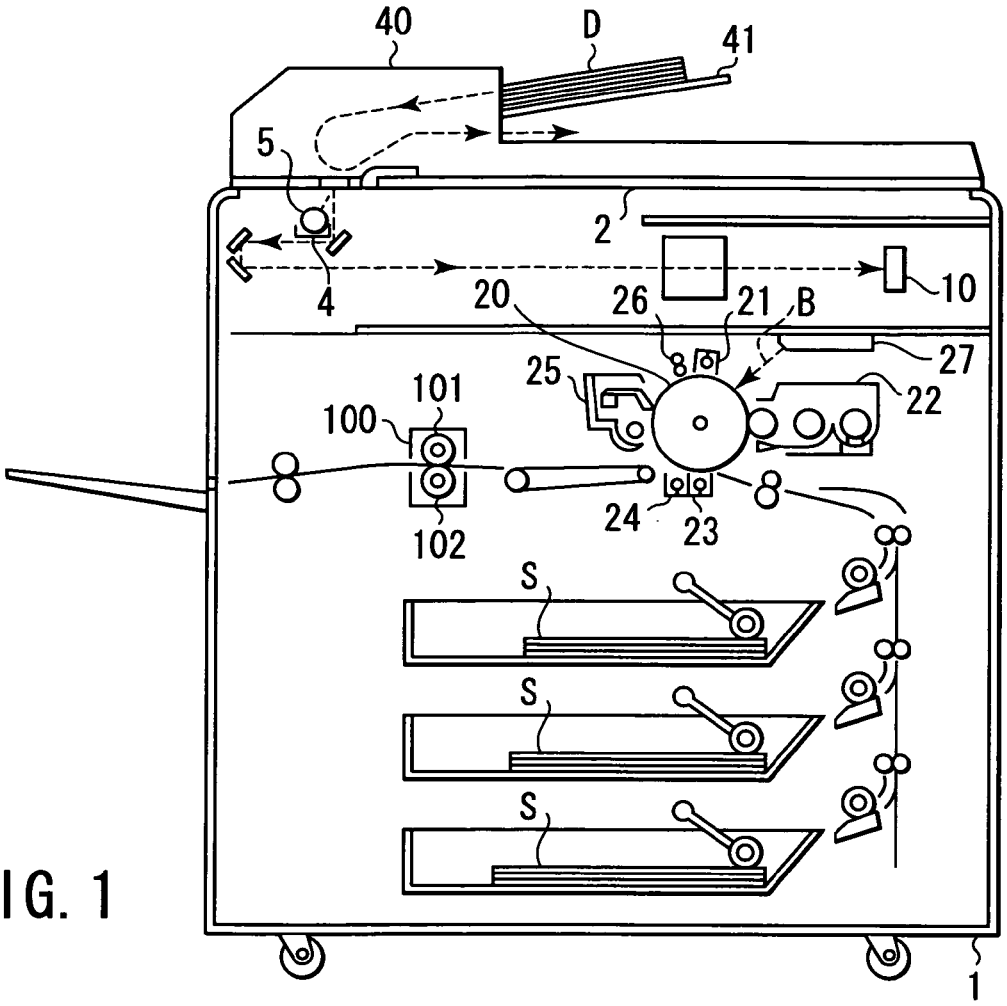
FIG. 1 is a schematic view showing an image forming apparatus which incorporates a fixing device to which an embodiment of the present invention can be applied.

FIG. 1 shows an example of a multifunction copying machine 1 as an image forming apparatus. A document table (glass plate) 2 on which a document D is set is arranged on the upper surface of the multifunction copying machine 1. The document D set on the document table 2 is illuminated with illumination light from an illumination exposure lamp 5 of a carriage 4 which is movably arranged along the document table 2.

Light reflected by the document D is photo-electrically converted by a photoelectric conversion element 10 such as a CCD (Charge Coupled Device). An image signal output from the CCD 10 is supplied to a laser unit 27. A laser beam B from the laser unit 27 illuminates a photosensitive body 20 (to be described below).

The photosensitive drum 20 is arranged at a predetermined position within the copying machine 1. By irradiating the photosensitive drum 20 with light while charging it, the drum 20 can hold a latent image.

The photosensitive drum 20 is sequentially surrounded by a charging unit 21, developing unit 22, transfer unit 23, separation unit 24, cleaner 25, charge removing unit 26, and the like. Although not described in detail, a latent image is formed on the photosensitive drum 20 by the laser beam B from the laser unit 27. The latent image formed on the photosensitive drum 20 is developed by toner selectively supplied from the developing unit, and transferred onto a copying sheet supplied at a predetermined timing. The toner transferred to the copying sheet is fixed onto the copying sheet by a fixing device 100 (to be described later).

Figure 2:
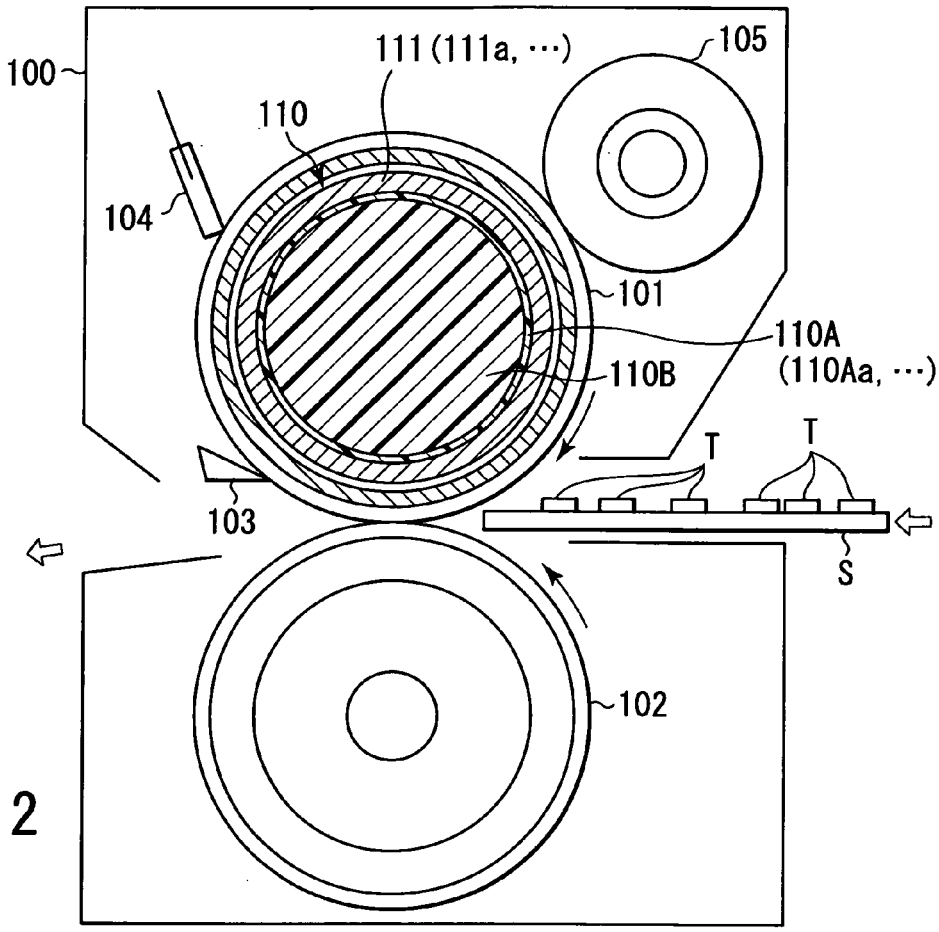
FIG. 2 is a schematic view showing an example of the fixing device to which the embodiment of the present invention can be applied.

FIG. 2 shows the schematic arrangement of the fixing device.

As shown in FIG. 2, the fixing device 100 comprises a heating roller 101 and press roller 102 at positions where these rollers vertically sandwich the convey path of a copying sheet S. The press roller 102 is in press contact with the outer surface of the heating roller 101 by a press mechanism (not shown). The contact between these rollers 101 and 102 has a predetermined nip width.

The heating roller 101 is constituted by forming a conductive material such as iron into a cylindrical shape and coating the outer surface of the iron cylinder with a fluoroplastic such as a tetrafluoroethylene resin. The heating roller 101 is rotated and driven right in FIG. 2 by a driving motor (not shown). The press roller 102 rotates left in FIG. 2 in response to rotation of the heating roller 101. The copying sheet S passes through the contact between the heating roller 101 and the press roller 102. The copying sheet receives heat from the heating roller 101 to fix onto the copying sheet S a developer image T on the copying sheet S.

The heating roller 101 is surrounded by a separation claw 103 for separating the copying sheet S from the heating roller 101, a cleaning member 104 for removing toner, paper dust, and the like from the heating roller 101, and a coating roller 105 for coating the surface of the heating roller 101 with a mold release agent.

The heating roller 101 incorporates an induction heating portion 110 for induction heating. The induction heating portion 110 has a coil bobbin 110A whose outer surface is wound with a wire serving as a coil 111, and a holding member 110B which holds the coil bobbin 110A. When the coil 111 is formed by a plurality of coils (111*a*, . . . ), the coil bobbin 110A is formed by a plurality of coil bobbins 110A (110Aa, . . . ) in correspondence with the number of coils. The induction heating portion 110 receives high-frequency power from a high-frequency circuit (to be described later), and generates a high-frequency magnetic field for induction heating. The high-frequency magnetic field generates an eddy current in the heating roller 101, and Joule heat by the eddy current causes self-heating of the heating roller 101.

Figure 3:
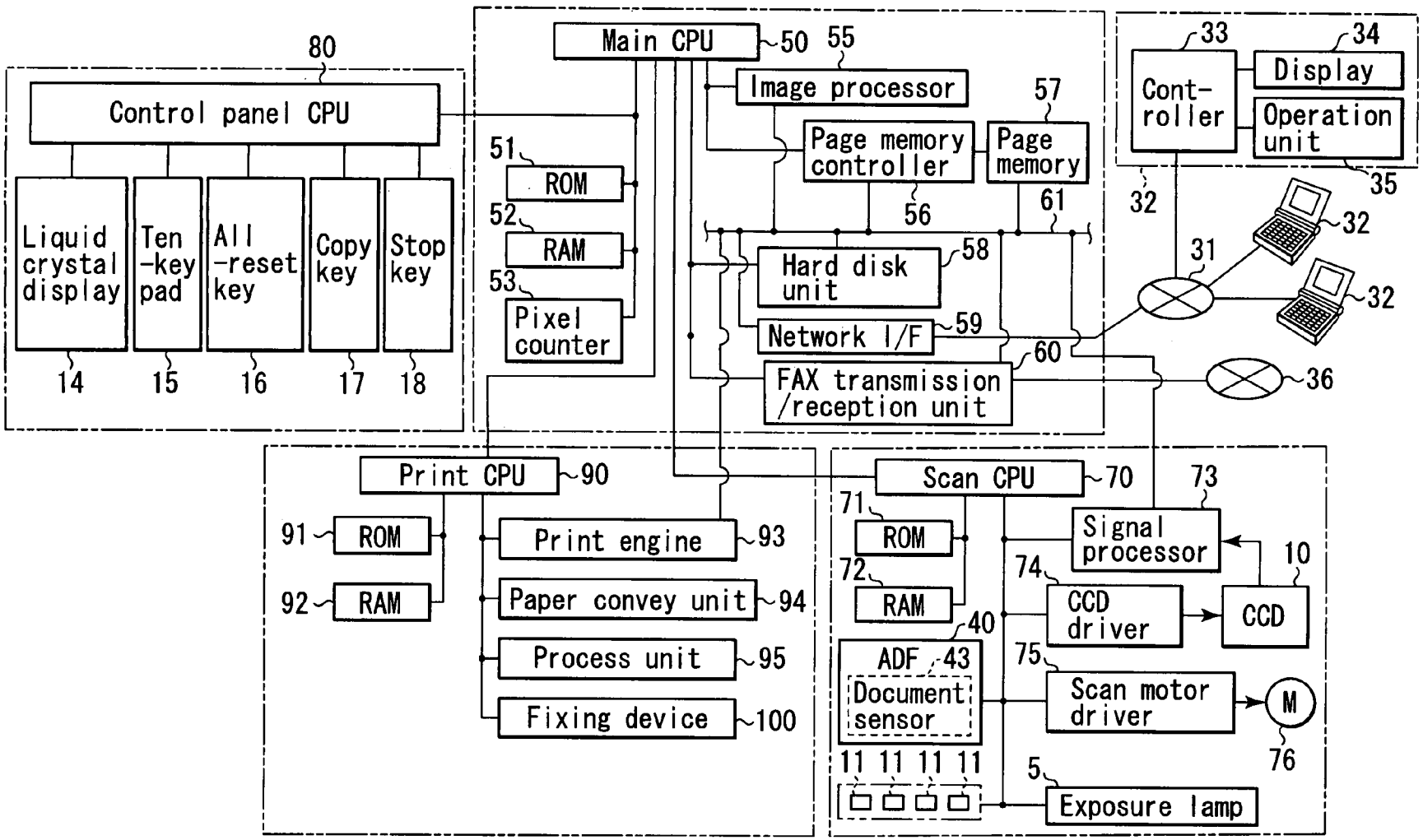
FIG. 3 is a block diagram for explaining the control system of the image forming apparatus shown in FIG. 1.

FIG. 3 is a block diagram for explaining the control system of the multifunction electrophotographic copying machine shown in FIG. 1. As shown in FIG. 3, a main CPU 50 is connected to a control program storage ROM 51, data storage RAM 52, pixel counter 53, image processor 55, page memory controller 56, hard disk unit 58, network interface 59, FAX transmission/reception unit 60, and the like. The main CPU 50 is connected to a scan CPU 70, control panel CPU 80, print CPU 90, and the like.

The main CPU 50 comprehensively controls the scan CPU 70, control panel CPU 80, and print CPU 90. The main CPU 50 functions as a copy mode control means corresponding to copy key operation, a printer mode control means corresponding to image input to the network interface 59, and a facsimile mode control means corresponding to image reception by the FAX transmission/reception unit 60.

The page memory controller 56 controls write/read of image data in/from a page memory 57. The image processor 55, page memory controller 56, page memory 57, hard disk unit 58, network interface 59, and FAX transmission/reception unit 60 are connected to each other via an image data bus 61.

The scan CPU 70 is connected to a control program storage ROM 71, a data storage RAM 72, a signal processor 73 which processes an output from the CCD 10 and supplies the processed data to the image data bus 61, a CCD driver 74, a scan motor driver 75, the exposure lamp 5, the automatic document feeder (ADF) 40, a plurality of document sensors 11, and the like.

The control panel CPU 80 is connected to a touch panel type liquid crystal display 14, ten-key pad 15, all-clear key 16, copy key 17, and stop key 18 on the control panel.

The print CPU 90 is connected to a control program storage ROM 91, a data storage RAM 92, a print engine 93, a paper convey unit 94, a process unit 95, and the fixing device 100. The print engine 93 is comprised of the laser unit 27, its driving circuit, and the like. The paper convey unit 94 is constituted by a paper convey mechanism from a paper feed cassette 30 to a tray 38, a driving circuit for this mechanism, and the like. The process unit 95 is formed by the photosensitive drum 20, its peripheral unit, and the like.

Figure 4:
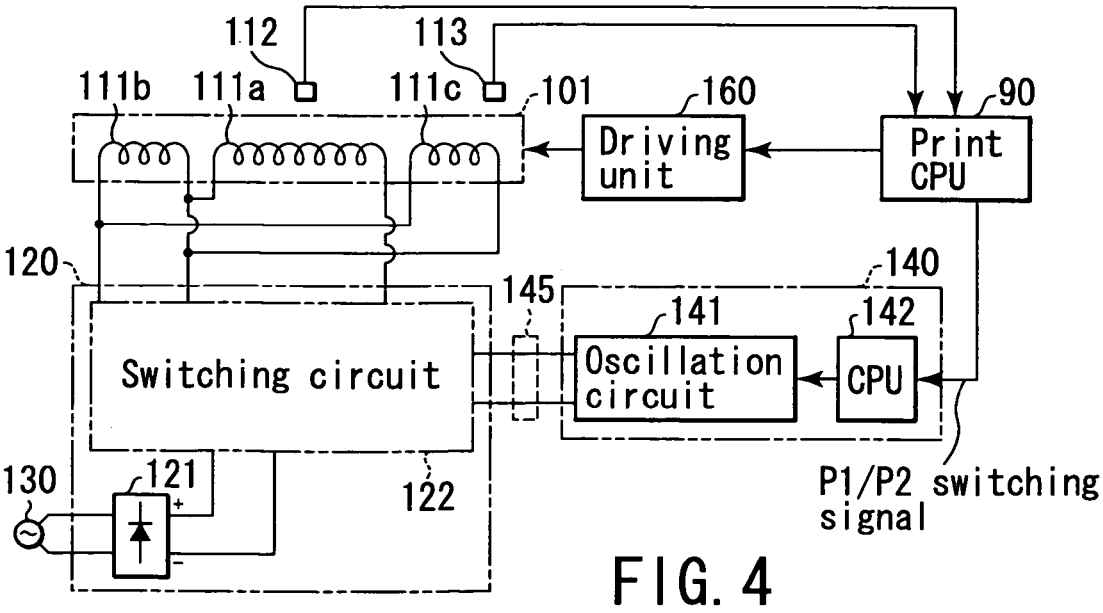
FIG. 4 is a block diagram for explaining the control system of the fixing device to which the embodiment of the present invention can be applied.

FIG. 4 shows an example of the arrangement of the electrical circuit of the fixing device 100.

The induction heating portion 110 stored in the heating roller 101 has the coil 111 including a plurality of coils (111*a*, 111*b*, and 111*c*). In the example shown in FIG. 4, the coil 111 is divided into the three coils 111*a*, 111*b*, and 111*c*. In the example shown in FIG. 4, the coil 111*a* forms the first coil, and is located at the center of the heating roller 101. The coils 111*b* and 111*c* form the second coil, and are located at positions where they sandwich the coil 111*a* in the heating roller 101. The coils 111*a*, 111*b*, and 111*c* are connected to a high-frequency generation circuit 120.

A temperature sensor 112 is arranged at the center of the heating roller 101. The temperature sensor 112 detects a temperature at the center of the heating roller 101. A temperature sensor 113 is arranged at one end of the heating roller 101. The temperature sensor 113 detects a temperature at one end of the heating roller 101. The temperature sensors 112 and 113 are connected to the print CPU 90 together with a driving unit 160 for rotating and driving the heating roller 101.

The print CPU 90 comprises a function of controlling the driving unit 160, in addition to a function of generating a P1/P2 switching signal for designating the operation of the first resonant circuit (output power P1: to be described later) constituted by the coil 111*a* serving as the first coil and the operation of the second resonant circuit (output power P2: to be described later) constituted by the coils 111*b* and 111*c* serving as the second coil, and a function of performing control in accordance with the output power of each resonant circuit and the detection temperatures of the temperature sensors 112 and 113.

The high-frequency generation circuit 120 generates high-frequency power for generating a high-frequency magnetic field. The high-frequency generation circuit 120 comprises a rectifying circuit 121, and a switching circuit 122 connected to the output terminal of the rectifying circuit 121. The rectifying circuit 121 rectifies an AC voltage applied from a commercial AC power supply 130. The switching circuit 122 forms the first resonant circuit by the coil 111*a*, and the second resonant circuit by the coils 111*b* and 111*c*.

The first and second resonant circuits are selectively excited by a switching element (e.g., a transistor such as an FET: not shown) arranged in the switching circuit 122.

The coils 111*b* and 111*c* which constitute the second coil are parallel-connected to the switching circuit 122. When the first or second coil is formed by a plurality of coils at the induction heating portion 110, the coils are similarly parallel-connected to the switching circuit 122.

The first resonant circuit has a resonance frequency f1 which is determined by the inductance of the coil 111*a*, the electrostatic capacitance of a capacitor (not shown) within the switching circuit 122, and the like. The second resonant circuit has a resonance frequency f2 which is determined by the inductances of the coils 111*b* and 111*c*, the electro-static capacitance of the capacitor (not shown) within the switching circuit 122, and the like.

The switching circuit 122 is ON/OFF-driven by a controller 140 in accordance with the P1/P2 switching signal from the print CPU 90. The controller 140 comprises an oscillation circuit 141 and CPU 142. The oscillation circuit 141 generates a driving signal having a predetermined frequency to the switching circuit 122. The CPU 142 controls the oscillation frequency of the oscillation circuit 141 (frequency of the driving signal). The CPU 142 has, e.g., the following means (1) and (2) as main functions.

(1) The CPU 142 has a control means for sequentially (alternately) exciting the first resonant circuit at a plurality of frequencies, e.g., (f1−Δf) and (f1+Δf) around the resonance frequency f1 when the operation of the first resonant circuit (using only the coil 111*a*) is designated by the P1/P2 switching signal from the print CPU 90.

(2) The CPU 142 has a control means for sequentially exciting the first and second resonant circuits at a plurality of frequencies, e.g., (f1−Δf), (f1+Δf), (f2−Δf), and (f2+Δf) around the resonance frequencies f1 and f2 when the operations of the first and second resonant circuits (using all the coils 111*a*, 111*b*, and 111*c*) are designated by the P1/P2 switching signal from the print CPU 90.

The operation of the electrical circuit of the fixing device 100 having the above arrangement will be explained.

When the oscillation circuit 141 generates a driving signal having the same frequency as (or a frequency close to) the resonance frequency f1 of the first resonant circuit, the switching circuit 122 is turned on/off by the driving signal to excite the first resonant circuit. Upon excitation, the coil 111*a* generates a high-frequency magnetic field. The high-frequency magnetic field generates an eddy current at the center of the heating roller 101 along the axis, and Joule heat by the eddy current causes self-heating at the center of the heating roller 101 along the axis.

When the oscillation circuit 141 generates a driving signal having the same frequency as (or a frequency close to) the resonance frequency f2 of the second resonant circuit, the switching-circuit 122 is turned on/off by the driving signal to excite the second resonant circuit. Upon excitation, the coils 111*b* and 111*c* generate a high-frequency magnetic field. The high-frequency magnetic field generates an eddy current at the two sides of the heating roller 101 along the axis, and Joule heat by the eddy current causes self-heating at the two sides of the heating roller 101 along the axis.

Figure 5:
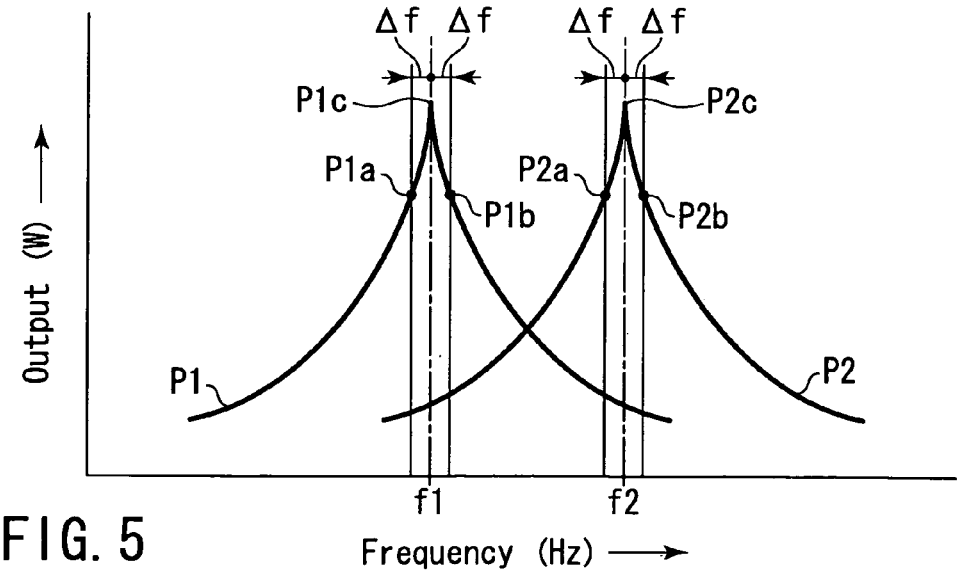
FIG. 5 is a graph showing the relationship between the output power of a resonant circuit shown in FIG. 4 and the frequency which excites the resonant circuit.

FIG. 5 is a graph showing the relationship between the output power P1 of the first resonant circuit and the frequency for exciting the first resonant circuit, and the relationship between the output power P2 of the second resonant circuit and the frequency for exciting the second resonant circuit.

As shown in FIG. 5, the output power P1 of the first resonant circuit exhibits a pattern in which the output power P1 reaches the peak level when the first resonant circuit is excited at the same frequency as the resonance frequency f1 of the first resonant circuit, and gradually decreases as the excitation frequency moves apart from the resonance frequency f1.

Similarly, the output power P2 of the second resonant circuit exhibits a pattern in which the output power P2 reaches the peak level when the second resonant circuit is excited at the same frequency as the resonance frequency f2 of the second resonant circuit, and gradually decreases as the excitation frequency moves apart from the resonance frequency f2.

In fixing on a large-size paper sheet S, both the first and second resonant circuits are excited, and all the coils 111*a*, 111*b*, and 111*c* generate a high-frequency magnetic field. The high-frequency magnetic field generates an eddy current in the entire heating roller 101, and Joule heat by the eddy current causes self-heating in the entire heating roller 101. In this case, the oscillation circuit 141 sequentially outputs driving signals having two frequencies (f1−Δf) and (f1+Δf) which are vertically separated by a predetermined value Δf in opposite directions from the resonance frequency f1 of the first resonant circuit. After that, the oscillation circuit 141 sequentially outputs driving signals having two frequencies (f2−Δf) and (f2+Δf) which are vertically separated by the predetermined value Δf in opposite directions from the resonance frequency f2 of the second resonant circuit.

With these driving signals, the first resonant circuit is sequentially excited at the two frequencies (f1−Δf) and (f1+Δf) which sandwich the resonance frequency f1 . The second resonant circuit is sequentially excited at the two frequencies (f2−Δf) and (f2+Δf) which sandwich the resonance frequency f2. Excitation is repeated at these frequencies.

As shown in FIG. 5, the output power P1 of the coil 111*a* in the first resonant circuit exhibits a value P1*a* slightly smaller than a peak level P1*c* upon excitation at the frequency (f1−Δf), and a value P1*b* slightly smaller than the peak level P1*c* upon excitation at the frequency (f1+Δf).

The output power P2 of the coils 111*b* and 111*c* in the second resonant circuit exhibits a value P2*a* slightly smaller than a peak level P2*c* upon excitation at the frequency (f2−Δf), and a value P2*b* slightly smaller than the peak level P1*c* upon excitation at the frequency (f2+Δf).

FIRST EMBODIMENT

An example of an induction heating portion 110 will be explained.

When a plurality of coils parallel-connected to a high-frequency generation circuit 120 are arranged at the induction heating portion 110, the connection of the coils becomes complicated. To prevent this, according to the first embodiment, one coil bobbin wound with a wire serving as one coil is designed as one coil unit, and a plurality of coil units are held by one holding member 110B to form the induction heating portion 110.

Each coil unit having this structure is fixed to a predetermined position by the holding member 110B for holding the coil on the same shaft as that of a heating roller 101. The holding member 110B is assembled inside a coil bobbin 110A of each coil unit. The holding member 110B and each coil bobbin 110A are fixed by fitting a projection in a recess (neither is shown) so as not to rotate each coil unit from the holding member 110B.

Figure 6:
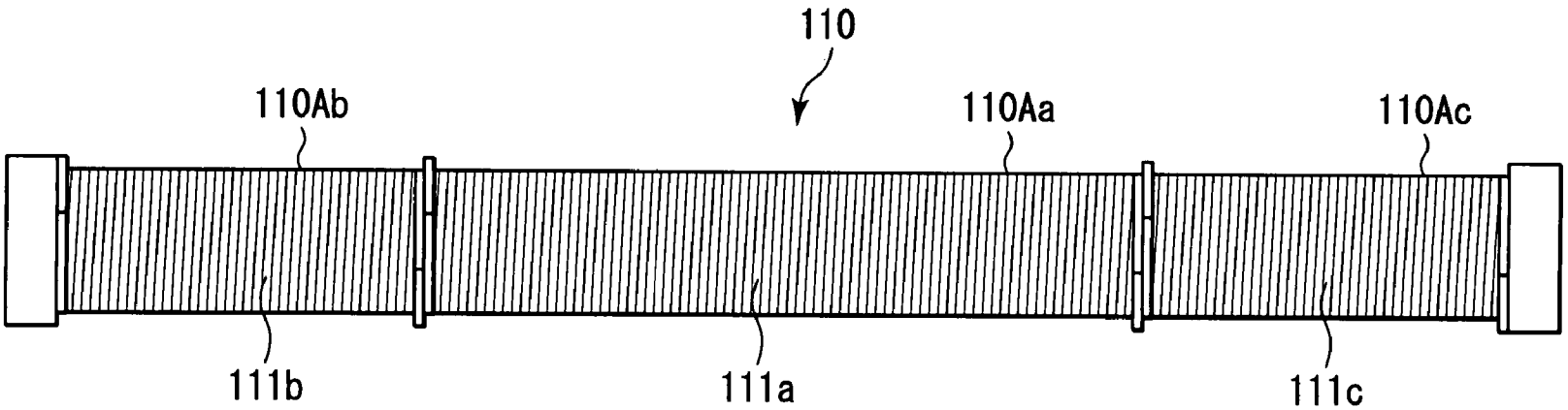
FIG. 6 is a plan view showing an example of an induction heating portion as the first arrangement example.
Figure 7:
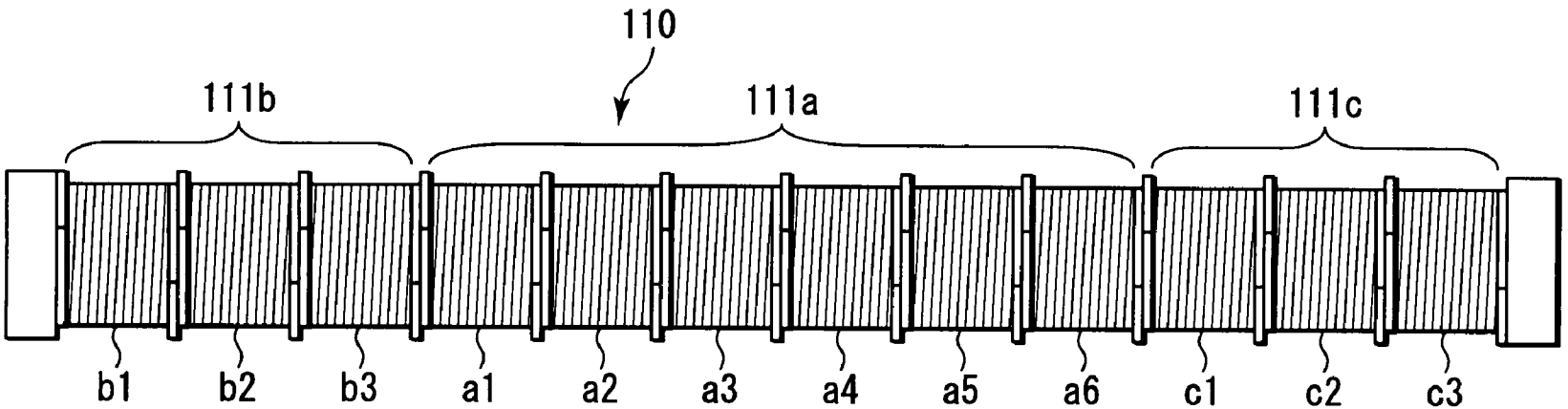
FIG. 7 is a plan view showing an example of the induction heating portion as the second arrangement example.

FIG. 6 shows the first arrangement example of the induction heating portion. FIG. 7 shows the second arrangement example of the induction heating portion.

In the example shown in FIG. 6, the induction heating portion 110 is comprised of three coils 111*a*, 111*b*, and 111*c*. The coil 111*a* is formed by a wire wound around a coil bobbin 110Aa, the coil 111*b* is formed by a wire wound around a coil bobbin 110Ab, and the coil 111*c* is formed by a wire wound around a coil bobbin 110Ac. That is, the induction heating portion 110 shown in FIG. 6 is constituted by holding the coil bobbins 110Aa, 110Ab, and 110Ac wound around the three coils 111*a*, 111*b*, and 111*c* by the holding member 110B.

In the example shown in FIG. 7, the induction heating portion 110 is comprised of 12 coils (a1 to a6, b1 to b3, and c1 to c3). Each coil is formed by a wire wound around an independent coil bobbin. At the induction heating portion 110 shown in FIG. 7, the coils a1 to a6 correspond to the coil 111*a*, the coils b1 to b3 correspond to the coil 111*b*, and the coils c1 to c3 correspond to the coil 111*c*.

When the first and second coils are formed by pluralities of coils, as shown in FIG. 7, the coils at the induction heating portion 110 are parallel-connected to a high-frequency generation circuit 120 as shown in FIG. 4. More specifically, the coils a1 to a6 corresponding to the coil 111*a* are parallel-connected to a switching circuit 122 at the portion of the coil 111*a* of the high-frequency generation circuit 120. The coils b1 to b3 corresponding to the coil 111*b* are parallel-connected to the switching circuit 122 at the portion of the coil 111*b* of the high-frequency generation circuit 120. The coils c1 to c3 corresponding to the coil 111*c* are parallel-connected to the switching circuit 122 at the portion of the coil 111*c* of the high-frequency generation circuit 120.

As shown in FIGS. 6 and 7, the entire induction heating portion is formed by holding a plurality of coils 111*a*, . . . wound around a plurality of coil bobbins 110Aa, . . . by the holding member 110B. At the entire induction heating portion, the number of coil bobbins (coil units) wound with coils must be equal to or larger than at least the number of objects to be controlled. In the fixing device according to the first embodiment, a plurality of coils are controlled. The induction heating portion must be constituted by coil units equal to or larger in number than at least coils to be controlled. Each coil to be controlled can also be formed by a plurality of coil units, as shown in FIG. 7.

Figure 8:
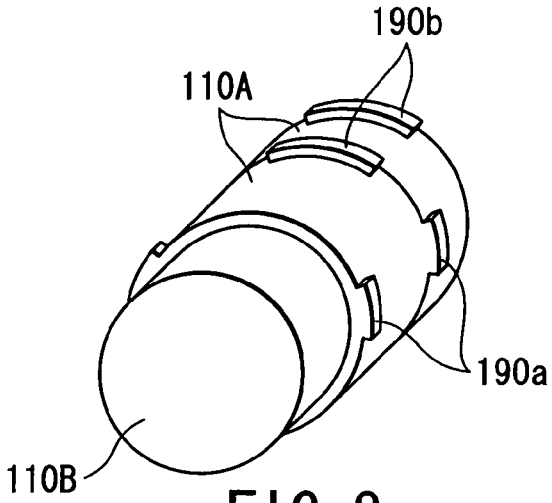
FIG. 8 is a perspective view showing an example of the relationship between a coil bobbin and a holding member.

FIG. 8 shows an example of the relationship between the coil bobbin and the holding member.

As shown in FIG. 8, each coil bobbin (coil holding portion) 110A has a hollow cylindrical shape. The holding member 110B is so shaped as to be stored in each coil bobbin 110A and fitted in the inner shape of the coil bobbin 110A. At the entire induction heating portion 110, a plurality of coil bobbins 110A are held by one holding member 110B, and adjacent coil bobbins 110A contact each other at their end faces and are arranged at predetermined positions. Each coil bobbin 110A has, at two ends, flanges (guides) 190*a* and 190*b* which guide a wire wound as the coil 111. The coil bobbin 110A and holding member 110B are formed by plastic, ceramic, or the like. For example, PEEK (polyetheretherketone), phenol, or unsaturated polyester is available.

The relationship between the interval (gap) between the coils at the holding member 110B and the temperature distribution on the heating roller will be explained.

Figure 9:
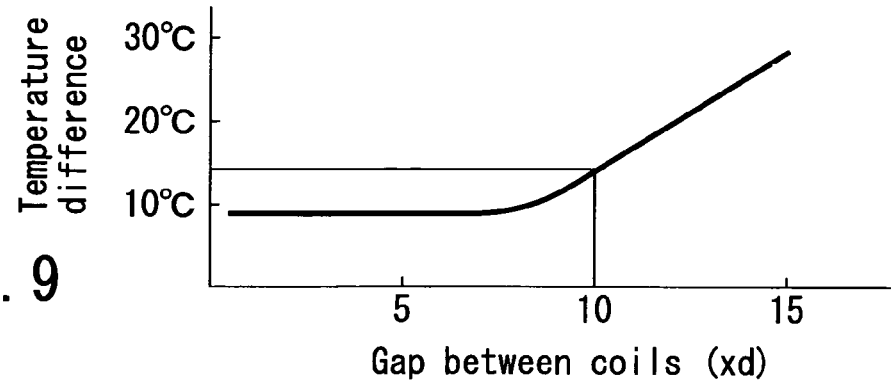
FIG. 9 is a graph for explaining the relationship between the gap between coil bobbins and the heat distribution on a heating roller.

FIG. 9 shows an example of the relationship between the gap between coils and the heat distribution on the heating roller.

The induction heating portion 110 having the above arrangement is constituted by winding each coil 111 of each coil unit on the same shaft as that of the heating roller 101. The gap between coils at the induction heating portion 110 influences the temperature distribution on the heating roller 101 serving as a member to be heated.

When power is simultaneously supplied to a plurality of coils 111, the temperature of the heating roller 101 between adjacent coils rises for a smaller gap between the coils, and drops for a larger gap.

The example shown in FIG. 9 represents the relationship between the gap between coils and the temperature difference on the heating roller 101 between the coils when d represents the diameter (thickness) of a wire which forms the coil 111. Assuming that the temperature difference on the heating roller 101 must be 15° C. or less in order to normally fix the developer onto a paper sheet, the allowance of the temperature difference on the heating roller 101 is 15° C. or less. In this case, the relationship shown in FIG. 9 reveals that the temperature difference exceeds 15° C. when the gap between coils is 10×d or more. In the example shown in FIG. 9, the gap between coils must be 10×d (10 times of the diameter of a wire which forms a coil) in order to suppress the temperature difference on the heating roller 101 to 15° C. or less.

In the first embodiment, the start and final ends of the wire of each coil are guided into the coil bobbin 110A, and connected to the high frequency generation circuit 120. At least the gap between coils must be set to d (wire diameter) or more.

To satisfy this condition, a gap z between coils must be equal to or larger than the diameter d of a wire which forms a coil, and equal to or smaller than 10×d which is the allowance of the temperature difference on the heating roller 101 necessary to maintain the fixing quality. Hence, the coil bobbin is designed such that the gap z between adjacent coils falls within $d \leqq z \leqq 10 \times d$.

As described above, according to the first embodiment, each coil bobbin wound with a plurality of coils used for the induction heating portion in the induction heating fixing device is so designed as to make the gap between coils fall within a predetermined allowable range. The design which satisfies this condition can provide an induction heating portion capable of stably maintaining the fixing quality in the fixing device which fixes a developer onto a paper sheet by heat from the heating roller.

Another example of the coil bobbin 110A will be explained.

Figure 10:
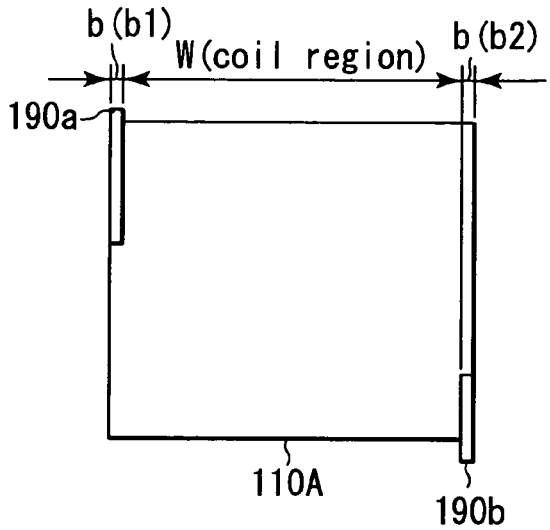
FIG. 10 is a plan view showing an example of a coil bobbin as the third arrangement example.

FIG. 10 is a view showing the third arrangement example of the coil bobbin 110A.

As shown in FIG. 10, the coil bobbin 110A has the flanges 190*a* and 190*b* at the two ends of the cylindrical main body. The coil bobbin 110A is wound with a wire serving as the coil 111 in the region (to be referred to as a coil region hereinafter) between the flanges 190*a* and 190*b*. The flanges 190*a* and 190*b* are guides which guide a wire serving as the coil 111 wound around the coil bobbin 110A. The flanges 190*a* and 190*b* are formed on at least part of the two ends of the coil bobbin 110A. However, the flanges 190*a* and 190*b* can take any formation position and shape as far as they hold a wire wound around the coil bobbin 110A with a desired number of turns.

Grooves (not shown) are formed at the two ends of the coil bobbin 110A. The start and final ends of the wire of the coil 111 wound around the coil bobbin 110A are guided into the coil bobbin 110A via these grooves, and connected to the high-frequency generation circuit 120.

On the coil bobbin 110A shown in FIG. 10, the region between the flanges 190*a* and 190*b* on the coil bobbin 110A is a coil region where the wire can be wound. When the flanges 190*a* and 190*b* are set at the two ends of the coil bobbin 110A, as shown in FIG. 10, the interval (gap) z between coils wound around adjacent coil bobbins 110A is defined by the widths of the flanges 190*a* and 190*b* adjacent to each other. In other words, when the adjacent flanges 190*a* and 190*b* have the same width, the gap z between coils is a value twice the width of the flange 190*a* or 190*b*.

Letting b be each of the width of the flange 190*a* and that of the flange 190*b*, as shown in FIG. 10, the gap z between the coils 111 wound around the coil bobbins 110A is z=2b. When W represents the width (coil region) between the flanges 190*a* and 190*b* and the condition of the gap z between coils is $d \leqq z \leqq 10 \times d$ for the diameter d of a wire which forms a coil, the width b of the flanges 190*a* and 190*b* of the coil bobbin 110A is so designed as to satisfy $d \leqq 2z \leqq 10 \times d$.

From this, the width b of the flanges 190*a* and 190*b* formed at the two ends of each coil bobbin 110A is so designed as to meet the above condition. The temperature difference on the heating roller 101 can be kept at the allowance or less, stably maintaining the fixing quality of the developer onto the paper sheet.

The flanges 190*a* and 190*b* have the same width b in the above example, but a width b1 of the flange 190*a* and a width b2 of the flange 190*b* may be different. In this case, the gap z between coils is z=b1+b2. The width b1 of the flange 190*a* and the width b2 of the flange 190*b* of the coil bobbin 110A are so designed as to satisfy $d \leqq b1 + b2 \leqq 10 \times d$.

As described above, according to the third arrangement example, the widths of the flanges at the two ends of each coil bobbin are designed such that the gap between adjacent coils becomes equal to or smaller than a predetermined allowance (within the allowable range). This arrangement can therefore provide a fixing device having an induction heating portion capable of stably maintaining the fixing quality.

The fourth arrangement example of the coil bobbin 110A will be described.

Figure 11:
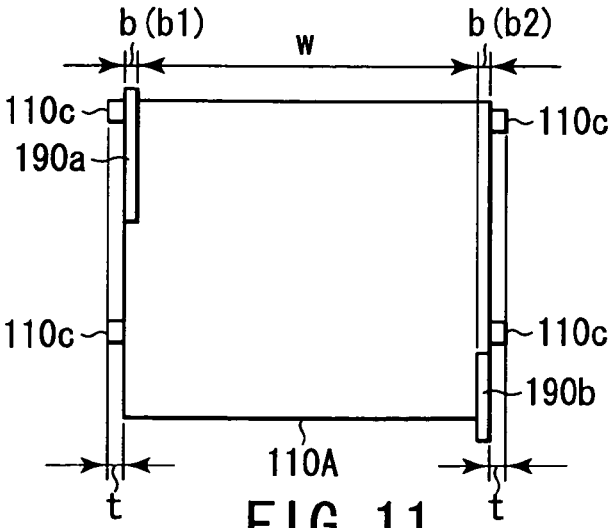
FIG. 11 is a plan view showing an example of the coil bobbin as the fourth arrangement example.
Figure 12:
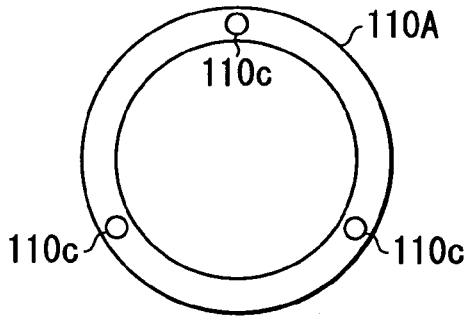
FIG. 12 is a plan view showing another example of the coil bobbin as the fourth arrangement example.

FIGS. 11 and 12 show the fourth arrangement example of the coil bobbin 110A.

In the fourth arrangement example shown in FIGS. 11 and 12, a plurality of projections 110C are formed on the end face (face adjacent to each coil bobbin) of the coil bobbin 110A in the third arrangement example shown in FIG. 10.

The projection 110C holds the interval between adjacent coil bobbins 110A. The coil bobbin 110A has a hollow cylindrical shape so as to be held by the holding member 110B. The projections 110C are arranged at a plurality of peripheral positions on the end face of the induction heating portion 110, as shown in FIG. 12.

The adjacent coil bobbins 110A have their projections 110C at positions where the projections 110C contact each other while the coil bobbins 110A are held by the holding member 110B. That is, the projections 110C of the adjacent coil bobbins 110A contact each other, and the coil bobbins 110A keep the distance between them constant while the coil bobbins 110A are held by the holding member 110B on the same shaft as that of the heating roller 101.

At the induction heating portion 110, each coil bobbin 110A is biased and arranged on the holding member 110B so as to tightly contact the holding member 110B on the same shaft as that of the heating roller 101. For example, the end faces of the coil bobbins 110A are arranged in contact with each other, like the third arrangement example. If the end face shape of each coil bobbin 110A has an error (in, e.g., parallelism or squareness), the rotation moment is applied to the coil 111, the stress on the coil bobbin 110A increases, or the gap between the coil 111 and the heating roller 101 becomes nonuniform due to inclination.

For example, when the rotation moment is applied to the coil 111 or the stress on the coil bobbin 110A increases, errors such as a failure of the fixing device may frequently occur. If the gap between the coil 111 and the heating roller 101 becomes nonuniform due to inclination of the coil bobbin 110A, the heat distribution may become nonuniform on the heating roller 101 heated by the induction heating portion 110, causing a fixing error.

To prevent this, the coil bobbin 110A held by the holding member 110B must be arranged such that the central axis does not incline from the rotating shaft of the heating roller 101 or the plane of the coil 111 does not incline from the heating roller 101. In the arrangement in which the end face of the coil bobbin 110A directly contacts that of an adjacent coil bobbin 110A, like the third arrangement example shown in FIG. 10, high precision is required for the side surface shape of the coil bobbin 110A.

To the contrary, in the fourth arrangement example shown in FIGS. 11 and 12, the projections 110C of adjacent coil bobbins are arranged in contact with each other. Even if the precision of the end face shape is low, the interval between the coil bobbins 110A can be accurately held as long as the height of each projection 110C is accurate. By arranging a plurality of projections 110C with a predetermined height on the end face (adjacent face) of the coil bobbin 110A, the gap between coils can be stably maintained at a predetermined value within a predetermined range with a simple arrangement. Any error such as inclination of the coil bobbin from the rotating shaft of the heating roller can be prevented.

Also in the fourth arrangement example, similar to the third arrangement example, the gap between the coils 111 wound around the coil bobbins 110A must be adjusted to a predetermined allowance or less.

As shown in FIGS. 11 and 12, letting $\underline{b}$ be the width of the flanges 190*a* and 190*b* and $\underline{t}$ be the height of the projection 110C, the gap $\underline{z}$ between coils is $z=2(b+t)$. When W represents the width (coil region) between the flanges 190*a* and 190*b* and the condition of the gap $\underline{z}$ between coils is $d \leqq z \leqq 10 \times d$ for the diameter $\underline{d}$ of a wire which forms a coil, the width $\underline{b}$ of the flanges 190*a* and 190*b* of the coil bobbin 110A and the height $\underline{t}$ of the projection 110C are so designed as to satisfy $d \leqq 2(b+t) \leqq 10 \times d$.

Hence, the width $\underline{b}$ of the flanges 190*a* and 190*b* formed at the two ends of each coil bobbin 110A and the projection 110C are so designed as to meet the above condition. The temperature difference on the heating roller 101 can be kept at the allowance or less, stably maintaining the fixing quality of the developer onto the paper sheet.

When the width b1 of the flange 190*a* and the width b2 of the flange 190*b* are different, the gap $\underline{z}$ between coils is $z=b1+b2+2t$. The width b1 of the flange 190*a* of the coil bobbin 110A, the width b2 of the flange 190*b*, and the height $\underline{t}$ of the projection 110C are so designed as to satisfy $d \leqq b1+b2+2t \leqq 10 \times d$.

As described above, according to the fourth arrangement example, the widths of the flanges at the two ends of each coil bobbin and the height of the projection on the end face of the coil bobbin are set such that the gap between adjacent coils falls within a predetermined allowable range. The gap between coils can be stably held at a predetermined value within a predetermined range with a simple arrangement. A fixing device having an induction heating portion capable of stably maintaining the fixing quality can be provided.

In the fourth arrangement example, the projections on the end faces of coil bobbins held by the holding member are so designed as to contact each other. The gap between coils can be stably held at a predetermined value within a predetermined range with a simple arrangement. Further, the precision in the arrangement of coil bobbins can be increased.

As described in detail above, the first embodiment of the present invention can provide a fixing device which heats a target member by a plurality of coils and can properly maintain the distance between a plurality of coils with a simple arrangement.

SECOND EMBODIMENT

Figure 13:
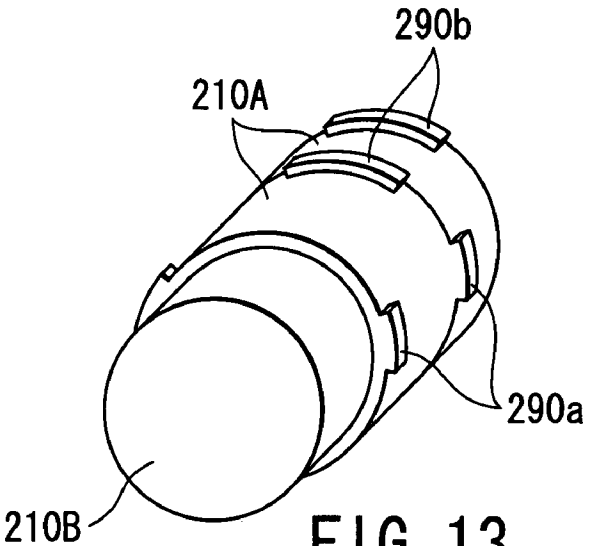
FIG. 13 is a perspective view showing another example of the relationship between the coil bobbin and the holding member.

FIG. 13 shows an example of the relationship between a coil bobbin 210A and a holding member 210B which can be used for an induction heating portion 110.

As shown in FIG. 13, each coil bobbin (coil holding portion) 210A has a hollow cylindrical shape. The holding member 210B is so shaped as to be stored in each coil bobbin 210A and fitted in the inner shape of the coil bobbin 210A.

At the entire induction heating portion 110, a plurality of coil bobbins 210A are held by one holding member 210B. Each coil bobbin 210A has, at two ends, flanges 290*a* and 290*b* which guide a wire wound as a coil 111. The coil bobbin 210A and holding member 210B are formed by plastic, ceramic, or the like. For example, PEEK (polyetheretherketone), phenol, or unsaturated polyester is available.

The features of the coil bobbin 210A and coil unit 210 will be explained.

At the induction heating portion 110 having the above arrangement, the interval (gap) between each coil 111 of each coil unit and a heating roller 101 serving as a member to be heated greatly influences the heat distribution on the heating roller 101. When power applied to the coil 111 is kept unchanged, the temperature of the heating roller 101 rises for a smaller gap between the coil 111 and the heating roller 101, and drops for a larger gap.

The coil bobbin 210A is cylindrical, and if the coil bobbin 210A is decentered, the heat distribution becomes nonuniform on the heating roller 101. The heating roller 101 of the fixing device used in an image forming apparatus must attain a uniform temperature distribution in at least a region where a paper sheet passes, in order to prevent any fixing error of the developer on the paper sheet. Thus, the gap between the coil 111 of the induction heating portion 110 and the heating roller 101 used in the fixing device must be adjusted to a predetermined distance.

From this, the coil bobbin 210A and holding member 210B used in the fixing device must have the following specifications and precision.

High precision is requested of the coil bobbin 210A for the following points.

(1) Cylindricity (in order to eliminate any decentering or the like and keep the interval between the heating roller and the coil constant)

(2) Difficulty of flash generation (in order not to damage a wire serving as a coil by a flash or the like)

(3) Moldability (because many coil bobbins are necessary)

(4) Heat resistance (because the coil bobbin is used at high temperature)

(5) Insulating property (in order to insulate the coil)

Also, high precision is requested of the holding member 210B for the following points.

(6) Less warpage (in order to maintain a predetermined gap from the heating roller)

(7) Heat resistance (because the holding member is used at high temperature)

(8) Insulating property (in order to insulate the coil and the wiring extending from the coil to the high-frequency generation circuit)

The requirements of items (1), (2), (3), and (6) can be realized by the precision in the molding step.

To satisfy these precisions, the second embodiment molds the holding member 210B by compression molding, and forms the coil bobbin 210A by injection molding.

If the holding member 210B is molded by compression molding, the holding member 210B hardly warps. Accordingly, the holding member which rarely warps can be molded. If the coil bobbin 210A is molded by injection molding, a flash is hardly generated, and many coil bobbins can be easily molded. Many coil bobbins can therefore be easily produced almost free from any flash while a predetermined cylindricity is maintained.

As described above, the second embodiment molds the holding member by compression molding and the coil bobbin by injection molding. Many coil bobbins almost free from any flash can be easily manufactured, and a holding member which rarely warps can be manufactured.

The material for forming the coil bobbin 210A and the material for forming the holding member 210B will be explained.

The heat resistance and insulating property such as those in items (4), (5), (7), and (8) are satisfied by materials for molding the coil bobbin 210A and holding member 210B. Since the coil bobbin 210A and holding member 210B are fitted and used at high temperature in the fixing device, materials having almost the same thermal expansion coefficient must be adopted.

The coil bobbin 210A and holding member 210B are preferably molded using, e.g., a material of the same grade (same material) capable of compression molding and injection molding.

The coil bobbin 210A and holding member 210B may also be molded using not a material of the same grade but materials having almost the same thermal expansion coefficient. For example, materials which satisfy the following conditions are available.

More specifically, the coil bobbin 210A and holding member 210B must maintain the part precision upon fitting at the maximum use temperature.

Let $\alpha 1$ be the linear expansion coefficient of a material (to be referred to as a compression molding material hereinafter) for molding the holding member 210B by compression molding, and $\alpha 2$ be the linear expansion coefficient of a material (to be referred to as an injection molding material hereinafter) for molding the coil bobbin 210A by injection molding. In this case, to suppress the difference in length L between the compression molding material and the injection molding material to D or less at the maximum use temperature (T° C.), the compression molding-material and injection molding material must satisfy $$D \geqq (\alpha 2-\alpha 1)\times(T-20)\times L \text{ (where } \alpha 2>\alpha 1)$$

For example, for the maximum use temperature T=240° C., L=4 mm, and D=50 μm, the linear expansion coefficient $\alpha 2$ of the injection molding material must satisfy for a compression molding material having $\alpha 1=1.1\times 10^{-5}$: $\alpha 2 \leqq 4.33\times 10^{-5}$.

For a compression molding material having a linear expansion coefficient of $1.5\times 10^{-5}$ or less, $\alpha 2/\alpha 1 \leqq 4$.

In other words, an injection molding material whose linear expansion coefficient is four times or less of that of the compression molding material must be adopted.

As described above, the compression molding material and injection molding material whose difference in precision at the maximum use temperature becomes a predetermined allowance or less can be easily determined on the basis of the linear expansion coefficients of the compression molding material and injection molding material. A material suitable for compression molding and a material suitable for injection molding are selected from those which satisfy the above conditions. The coil bobbin and holding member which maintain a predetermined part precision at a predetermined high temperature can be easily molded.

As described in detail above, the second embodiment of the present invention can provide a fixing device which exhibits high fitting precision even in use at high temperature and has an induction heating portion formed by a coil bobbin and holding member that satisfy various molding conditions.

THIRD EMBODIMENT

Another example of the arrangement of an induction heating portion will be explained.

Figure 14:
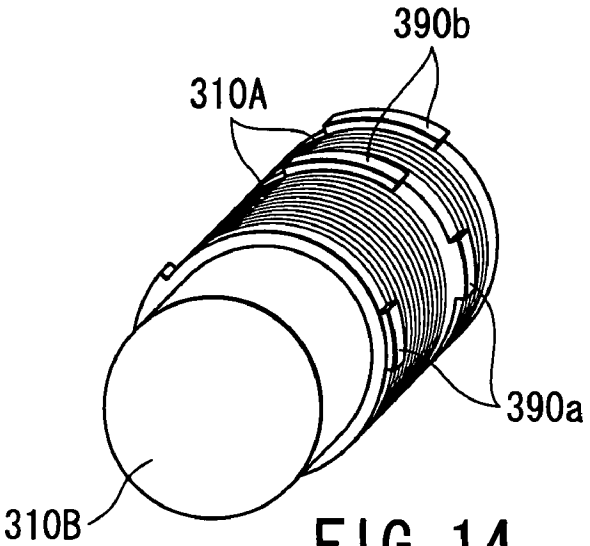
FIG. 14 is a perspective view showing still another example of the relationship between the coil bobbin and the holding member.

FIG. 14 shows an example of the relationship between a coil bobbin 310A and a holding member 310B usable for an induction heating portion 110.

As shown in FIG. 14, each coil bobbin (coil holding portion) 310A has a hollow cylindrical shape. The holding member 310B is so shaped as to be stored in each coil bobbin 310A and fitted in the inner shape of the coil bobbin 310A.

At the entire induction heating portion 110, a plurality of coil bobbins 310A are held by one holding member 310B. Each coil bobbin 310A has, at two ends, flanges 390*a* and 390*b* which guide a wire wound as a coil 111. The region between the flanges 390*a* and 390*b* where the coil 111 is wound around the coil bobbin 310A will be called a coil region, and the width (between the flanges 390*a* and 390*b*) of the coil region is defined as an effective bobbin width. The coil bobbin 310A and holding member 310B are formed by plastic, ceramic, or the like. For example, PEEK (polyetheretherketone), phenol, or unsaturated polyester is available.

Figure 15:
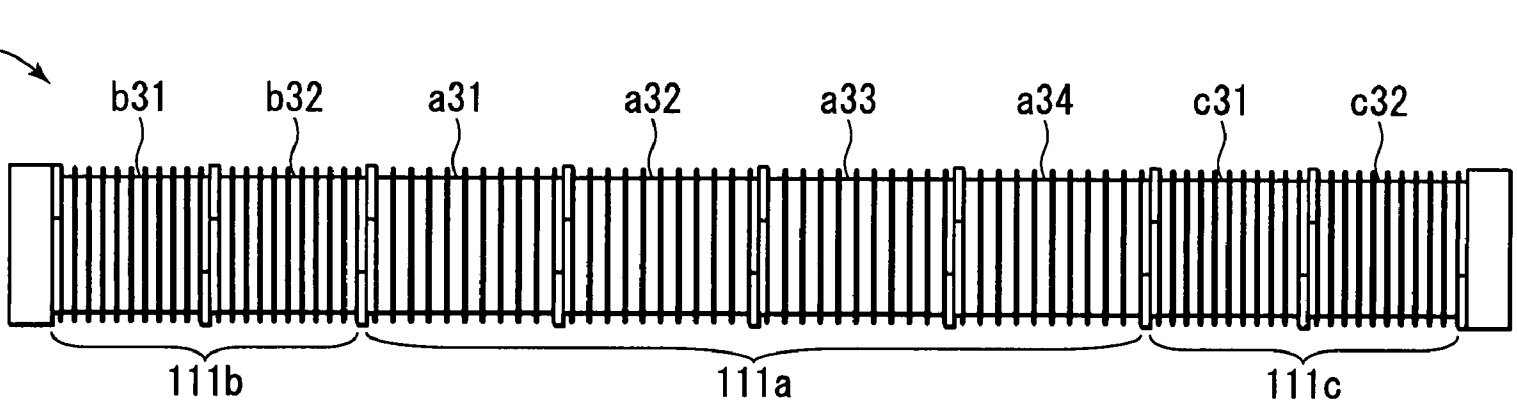
FIG. 15 is a plan view showing an example of the induction heating portion as the fifth arrangement example.

FIG. 15 shows the fifth arrangement example of the induction heating portion.

Figure 17:
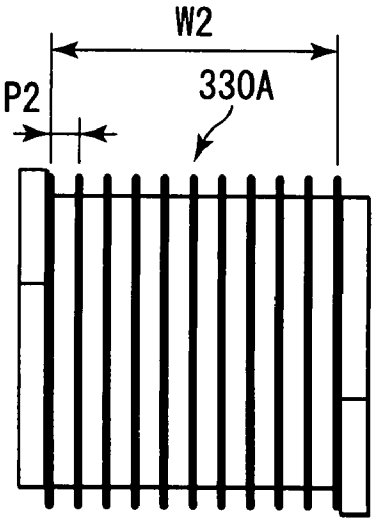
FIG. 17 is a plan view showing another example of the coil bobbin at the induction heating portion shown in FIG. 15.
Figure 16:
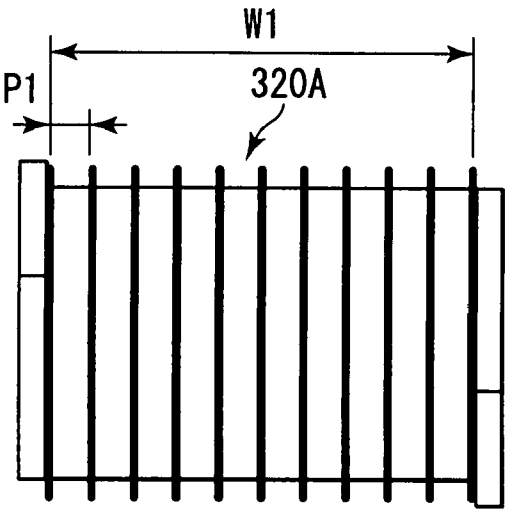
FIG. 16 is a plan view showing an example of the coil bobbin at the induction heating portion shown in FIG. 15.

FIG. 16 shows the arrangement of a first coil bobbin 320A wound with a first coil 111*a* at the induction heating portion in the fifth arrangement example of FIG. 15. FIG. 17 shows the arrangement of a second coil bobbin 330A wound with second coils 111*b* and 111*c* at the induction heating portion in the fifth arrangement example of FIG. 15.

In the example shown in FIG. 15, the induction heating portion 110 is formed by eight coils (a31 to a34, b31, b32, c31, and c32). The coils a31 to a34 are formed by wires wound around independent coil bobbins 320A, whereas the coils b31, b32, c31, and c32 are formed by wires wound around independent coil bobbins 330A. The induction heating portion 110 shown in FIG. 15 is constituted by holding by the holding member 310B a plurality of coils (a31 to a34) wound around a plurality of coil bobbins 320A and a plurality of coils (b31, b32, c31, and c32) wound around a plurality of coil bobbins 330A.

At the induction heating portion 110 shown in FIG. 15, the coils a31 to a34 correspond to the coil 111*a* serving as the first coil in the circuit arrangement shown in FIG. 4. The coils b31 and b32 correspond to the coil 111*b* serving as the second coil in the circuit arrangement shown in FIG. 4. The coils c31 and c32 correspond to the coil 111*c* serving as the second coil in the circuit arrangement shown in FIG. 4.

When the first or second coil is formed by a plurality of coils, as shown in FIG. 15, the coils at the induction heating portion 110 are connected to a high-frequency generation circuit 120 as shown in FIG. 4 as follows.

The coils a31 to a34 are parallel-connected to a switching circuit 122 at the portion of the coil 111*a* of the high-frequency generation circuit 120. The coils b31 and b32 are parallel-connected to the switching circuit 122 at the portion of the coil 111*b* of the high-frequency generation circuit 120. The coils c31 to c32 are parallel-connected to the switching circuit 122 at the portion of the coil 111*c* of the high-frequency generation circuit 120.

Energization control of the first coil (coils a31 to a34) and the second coil (coils b31, b32, c31, and c32) is executed on the basis of a temperature detected by a temperature sensor 112 which detects a temperature at the center of a heating roller 101, and a temperature detected by a temperature sensor 113 which detects a temperature at one end of the heating roller 101. The temperature sensor 112 detects the temperature of a region where the heating roller 101 is heated by the first coil. The temperature sensor 113 detects the temperature of a region where the heating roller 101 is heated by the second coil.

That is, energization control of each coil at the induction heating portion 110 in the fifth arrangement example is generally performed on the basis of the detection result of the temperature sensor 112 corresponding to the first coil and the detection result of the temperature sensor 112 or 113 corresponding to the second coil. In general, a lower one of the temperatures of the two temperature sensors 112 and 113 is controlled to a predetermined fixing temperature. Energization distribution at this time is as follows.

When the detection temperature of the temperature sensor 112 corresponding to the first coil is lower than that of the temperature sensor 113 corresponding to the second coil, the output ratio of the first coil to the second coil (first coil: second coil) is controlled to "about 80:20 to 90:10".

When the detection temperature of the temperature sensor 113 corresponding to the second coil is lower than that of the temperature sensor 112 corresponding to the first coil, the output ratio of the first coil to the second coil (first coil: second coil) is controlled to "about 40:60 to 30:70".

When the numbers of turns of coils change at the induction heating portion 110 connected to the high-frequency generation circuit 120, but the impedance of parallel-connected coils to the high-frequency generation circuit 120 does not change, power control over the induction heating portion 110 by the high-frequency generation circuit 120 does not change. However, when the numbers of turns of coils are different even with the same total impedance of parallel-connected coils at the induction heating portion 110, powers applied to the respective coils become different.

In other words, even in the same power control by the high-frequency generation circuit 120, different numbers of turns of coils influence the heat distribution of the heating roller 101 (temperature distribution on the heating roller 101) heated by the coils. To apply the same power to the respective coils, the numbers of turns of the coils must be set equal.

The fixing device used in an image forming apparatus generally performs fixing processing for paper sheets having various widths from A3 to a postcard size. Any measure must be employed to make the temperature distribution uniform on the heating roller 101. The powers of all parallel-connected coils at the induction heating portion 110 are controlled by the high-frequency generation circuit 120. Thus, powers for heating the heating roller 101 in regions corresponding to coils having the same number of turns become equal.

Power per unit area applied to the heating roller (member to be heated) can be changed by winding various coils which are formed by wires with the same number of turns at different winding intervals (winding pitches), around various coil bobbins with different effective bobbin widths. Even coil bobbins wound with coils having the same number of turns can form a desired temperature distribution on the heating roller 101 by changing the effective bobbin width.

For example, the induction heating portion 110 in the fifth arrangement example shown in FIG. 15 comprises the first coil (a31 to a34) which has a predetermined number of turns and the second coil (b31, b32, c31, and c32) which is arranged on one or two sides of the first coil and has the same number of turns as that of the first coil. At the induction heating portion 110 in the fifth arrangement example shown in FIG. 15, the first coil (a31 to a34) is wound around a plurality of first coil bobbins 320A having a first effective bobbin width W1 as shown in FIG. 16. The second coil (b31, b32, c31, and c32) is wound around a plurality of second coil bobbins 330A having a second effective bobbin width W2 as shown in FIG. 17.

The first effective bobbin width W1 of each first coil bobbin 320A wound with the first coil is set larger than the second effective bobbin width W2 of each second coil bobbin 330A wound with the second coil. In this case, letting P1 be the winding pitch (winding interval) of a wire serving as the first coil wound in the coil region of the first coil bobbin 320A, P2 be the winding pitch (winding interval) of a wire serving as the second coil wound in the coil region of the second coil bobbin 330A, and n be the number of turns of each coil, the relationship between P1 and P2 is given by $P1=(W1-W2)/(n-1)+P2$.

By adjusting the effective bobbin width of each coil bobbin, there can be provided an induction heating portion capable of easily changing the temperature distribution to a desired one on the heating roller 101 by a simple arrangement even immediately after power-on or in feeding paper sheets of various sizes.

Still another example of the arrangement of the induction heating portion will be explained.

Figure 18:
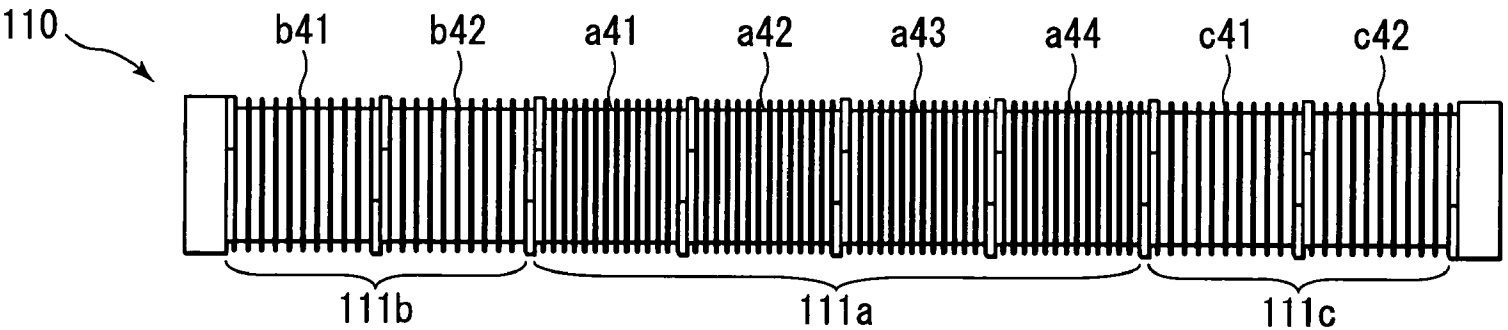
FIG. 18 is a plan view showing an example of the induction heating portion as the sixth arrangement example.
Figure 19:
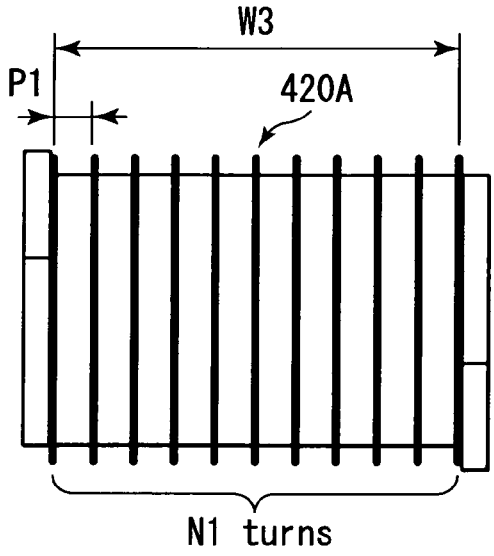
FIG. 19 is a plan view showing an example of the coil bobbin at the induction heating portion shown in FIG. 18.
Figure 20:
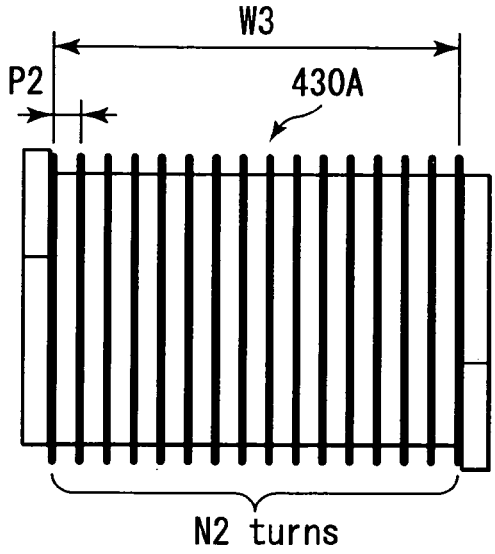
FIG. 20 is a plan view showing another example of the coil bobbin at the induction heating portion shown in FIG. 18.

FIG. 18 shows the sixth arrangement example of the induction heating portion. FIG. 19 shows the arrangement of a first coil bobbin 420A wound with the first coil 111*a* at the induction heating portion of FIG. 18. FIG. 20 shows the arrangement of a second coil bobbin 430A wound with the second coils 111*b* and 111*c* at the induction heating portion of FIG. 18.

Similar to the induction heating portion in the fifth arrangement example shown in FIG. 15, the induction heating portion 110 shown in FIG. 18 is formed by eight coils (a41 to a44, b41, b42, c41, and c42). As for the induction heating portion 110 in the sixth arrangement example shown in FIG. 18, the connection state to the high-frequency generation circuit 120 and energization control by the high-frequency generation circuit 120 are the same as those of the induction heating portion in the fifth arrangement example shown in FIG. 15, and a detailed description thereof will be omitted.

The induction heating portion 110 shown in FIG. 18 comprises the first and second coils wound around a plurality of coil bobbins with the same effective bobbin width W3, as shown in FIGS. 19 and 20. More specifically, the induction heating portion 110 in the sixth arrangement example shown in FIG. 18 has a plurality of first coil bobbins which have the effective bobbin width W3 and are wound around the first coils (a41 to a44) with a number N1 of turns, as shown in FIG. 19, and a plurality of second coil bobbins which have the effective bobbin width W3 and are wound around the second coils (b41, b42, c41, and c42) with a number N2 of turns different from the number N1 of turns, as shown in FIG. 20.

As described above, even in the same power control by the high-frequency generation circuit 120, the heat distribution of the heating roller 101 (temperature distribution on the heating roller) heated by each coil can be changed by changing the number of turns of the coil. That is, the induction heating portion 110 of the sixth arrangement example as shown in FIG. 18 changes power applied to each coil to adjust the temperature distribution to a desired one on the heating roller 101.

From this, power per unit area to the heating roller (member to be heated) can be changed by winding wires with different numbers of turns around a plurality of coil bobbins with the same effective bobbin width. Even when the induction heating portion is designed using a plurality of coil bobbins with the same effective bobbin width, a desired temperature distribution can be formed on the heating roller by changing the number of turns of the coil wound around each coil bobbin.

For example, as shown in FIG. 18, the first coil 111*a* (a41 to a44) is arranged at the center, and the second coils 111*b* (b41 and b42) and 111*c* (c41 and c42) are arranged at the two sides. To make the heat distribution uniform on the heating roller 101, the number N1 of turns of the first coil and the number N2 of turns of the second coil must be set to different values. For example, as shown in FIGS. 19 and 20, letting N1 be the number of turns of the first coil and N2 be the number of turns of the second coil, the numbers N1 and N2 of turns are set to N1<N2. This setting can provide an induction heating portion which can easily adjust the temperature distribution to a desired uniform temperature distribution on the heating roller 101 even immediately after power-on or in feeding paper sheets of various sizes and realize stable fixing processing.

The temperature distribution on a member to be heated can be set to a desired one by winding coils with different numbers of turns around a plurality of coil bobbins with the same effective bobbin width. The induction heating portion can be formed using a plurality of identical coil bobbins. Coil units can be commonly designed, preventing an assembly error and reducing the manufacturing cost of the induction heating portion.

As described in detail above, the third embodiment of the present invention can provide a fixing device having an induction heating means capable of adjusting the temperature distribution to a desired one on the member heated by a coil by using a simple arrangement.

FOURTH EMBODIMENT

Still another example of the arrangement of an induction heating portion will be explained.

Figure 21:
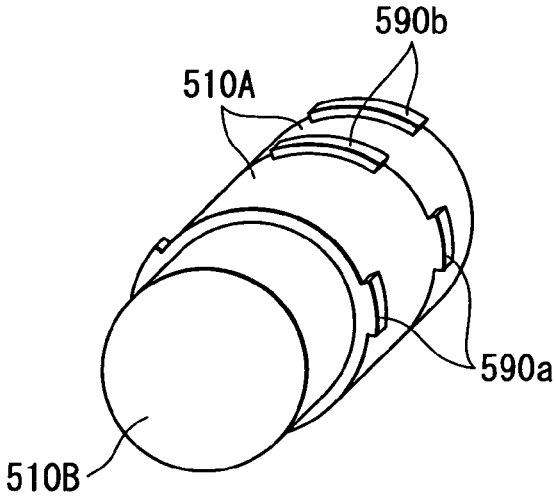
FIG. 21 is a perspective view showing still another example of the relationship between the coil bobbin and the holding member.

FIG. 21 shows an example of the relationship between a coil bobbin 510A and a holding member 510B which can be used for an induction heating portion 110.

As shown in FIG. 21, each coil bobbin (coil holding portion) 510A has a hollow cylindrical shape. The holding member 510B is so shaped as to be stored in each coil bobbin 510A. That is, the coil bobbins 510A are held by one holding member 510B to constitute the induction heating portion 110.

Each coil bobbin 510A has, at two ends, flanges (guides) 590*a* and 590*b* which guide a wire wound as a coil. The coil bobbin 510A and holding member 510B are formed by plastic, ceramic, or the like. For example, a material with high heat resistance and a small linear expansion coefficient such as PEEK (polyetheretherketone), liquid crystal polymer, phenol, or unsaturated polyester is available.

Figure 22:
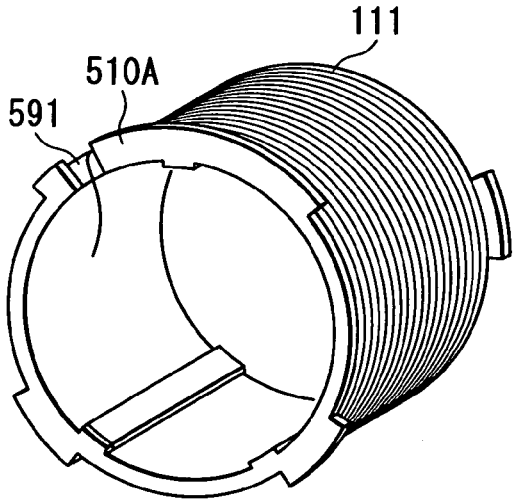
FIG. 22 is a perspective view showing still another example of the coil bobbin.

FIG. 22 shows the coil bobbin 510A wound with a coil 111.

On the coil bobbin 510A, the wire is wound as a coil in the region between the flanges 590*a* and 590*b*. Grooves 591 are formed at the two ends of the coil bobbin 510A. The start and final ends of a wire serving as the coil wound around the coil bobbin 510A are guided into the coil bobbin via the grooves 591.

As shown in FIG. 22, the wire serving as the coil wound around the coil bobbin 510A is guided by the flanges 590*a* and 590*b*. The region (to be referred to as a coil region hereinafter) where the wire can be wound as a coil around the coil bobbin 510A is the region between the flanges 590*a* and 590*b*.

In the example shown in FIGS. 21 and 22, the flanges 590*a* and 590*b* are formed on part of the two ends of the coil bobbin 510A. However, the flanges 590*a* and 590*b* can take any formation position and shape as far as they hold a wire wound around the coil bobbin 510A with a desired number of turns.

The width of the coil bobbin 510A will be explained.

When the wire is wound as a coil around the coil bobbin 510A, the wire is preferably wound in the coil region as tightly as possible. This is because the density of the wire wound around the coil bobbin 510A influences the heat distribution on the heating roller 101. If, for example, the density of the wire serving as the coil 111 wound around the coil bobbin 510A varies, the heat distribution on the heating roller 101 heated by the coil 111 may become nonuniform.

In general, the fixing device used in an image forming apparatus must control the heat distribution uniform on the heating roller 101 in at least a region where a paper sheet passes, in order to prevent any fixing error of toner on the paper sheet.

The coil position on the coil bobbin 510A can be fixed by tightly winding a wire serving as a coil between the flanges 590*a* and 590*b*. That is, heat distribution nonuniformity on the heating roller 101 heated by the coil can be prevented by tightly winding a wire between the flanges 590*a* and 590*b* and fixing the coil position on the coil bobbin 510A.

Figure 23:
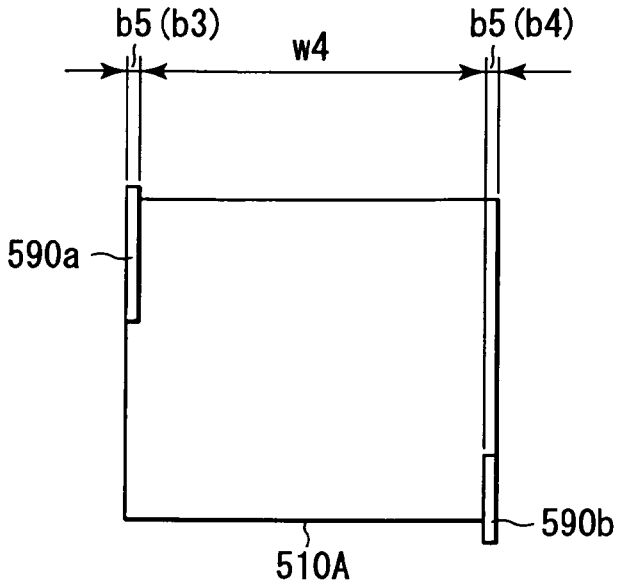
FIG. 23 is a plan view showing the relationship between the flange width and the coil region width in the coil bobbin.

FIG. 23 shows the relationship between a width b3 of the flange 590*a* and a width b4 of the flange 590*b* on the coil bobbin 510A, and a width (coil region width) W4 of the interval between the flanges 590*a* and 590*b*. The width b3 of the flange 590*a* and the width b4 of the flange 590*b* are set to the same width b5 in this example, but may be different from each other.

As described above, the region between the flanges 590*a* and 590*b* is a coil region where the wire can be wound. When the flanges 590*a* and 590*b* are set at the two ends of the coil bobbin 510A, as shown in FIG. 23, the width of the coil bobbin 510A is defined by the width b5 of the flanges 590*a* and 590*b* and the width W4 (of the coil region) between the flanges 590*a* and 590*b*.

When the flanges 590*a* and 590*b* are molded with a predetermined shape having the predetermined width b5, the width of the coil bobbin 510A is determined on the basis of the coil region width W4. A width W0 which is minimum in theory as the coil region width W4 is determined by a wire diameter d and a number n of turns as: W0=d×(n+1).

The coil region width W0 is a theoretically minimum width as the coil region width on the assumption that the diameter d of the wire wound around the coil bobbin 510A does not have any error. In theory (wire diameter does not have any error), the wire serving as the coil 111 can be completely tightly fixed onto the coil bobbin 510A by setting the coil region width to the width (theoretically minimum width) W0.

However, an actual wire includes a wire diameter error. The coil bobbin width also includes a molding error or the like.

In the fourth embodiment, requirements for the coil region width W4 are to satisfy the following conditions (A) and (B).

(A) The wire with a predetermined number of turns must have a width with which the wire does not overlap the flanges 590*a* and 590*b*. This condition is the condition of a minimum coil region width Wmin actually necessary as the coil region width W4. That is, this condition is necessary to reliably wind a wire with a predetermined number of turns in the coil region.

(B) The margin of the coil region width must be three times or less of the wire diameter with respect to the width of a wire diameter with a predetermined number of turns. This condition is the condition of a maximum coil region width Wmax actually allowable as the coil region width W4. This condition exhibits the maximum margin given to a wire wound in the coil region with a predetermined number of turns. As the upper limit of the coil region width, this condition represents a range where the wire wound around the coil bobbin hardly spreads. The margin corresponding to three times of the wire diameter assumes a range where the spring-back press force of a wire serving as a coil to another wire is obtained. Particularly when the wire is laid out through the interior of the coil bobbin at the end of the coil bobbin 510A, as shown in FIG. 22, and the margin of the coil region width exceeds three times (3×d) of the wire diameter, the spring-back press force of the wire to another wire disappears and the wire readily spreads.

Letting ±Δd be the tolerance (error) range of the wire and ±ΔW be the tolerance (error) range of the coil bobbin width, in order to satisfy the above conditions, the coil region width W4 must satisfy conditions:

$$W\mathrm{min}=(d+\Delta d)\times(n+1)+\Delta W$$

$$W\mathrm{max}=(d-\Delta d)\times(n+1)-\Delta W+3d$$

$$W\mathrm{min}\leqq W4<W\mathrm{max}.$$

The width of the coil bobbin 510A is the sum of the coil region width and the widths of the flanges 590*a* and 590*b*. The width of the coil bobbin 510A is therefore W4+2b5 (or W4+(b3+b4)). That is, the width (W4+2b5) of the coil bobbin 510A is so set as to satisfy Wmin+2b5≦W4+2b5<Wmax+2b5.

As the first example, for the number n of turns of the wire=48.5, the wire diameter d=0.554 mm, the wire diameter tolerance range Δd=0.006 mm, and the coil bobbin width tolerance range ΔW=0.1 mm, 27.82≦W4<28.688.

In this case, the coil region width W4 is set to, e.g., 28 mm, and the width of the entire coil bobbin is set to 28+2b5 (or 28+b3+b4).

As the second example, for the number n of turns of the wire=44.5, the wire diameter d=0.554 mm, the wire diameter tolerance range Δd=0.006 mm, and the coil bobbin width tolerance range ΔW=0.1 mm, 25.58≦W4<26.496.

In this case, the coil region width W4 is set to, e.g., 26 mm, and the width of the entire coil bobbin is set to 26+2b5 (or 26+b3+b4).

The flanges which hold the two ends of the coil are so arranged as to tightly wind a wire forming a coil on the coil bobbin. The coil formed by the wire wound around the coil bobbin can be fixed at a uniform density by a simple arrangement, providing a high-precision coil. The coil can be reliably held by the coil bobbin and flanges, the wire can be wound with an accurate number of turns, and an error can be easily determined.

When the induction heating portion is formed by a plurality of coils using a plurality of coil bobbins, coil bobbins having identical flanges are adopted. This enables using common coil bobbins wound with a plurality of coils. Molding of a coil bobbin, winding of a wire around a coil bobbin, and the like can be made common and simplified. An assembly failure, an erroneous number of turns, and the like can be prevented in advance, and a low-cost induction heating portion can be provided.

According to the fourth embodiment, the width between flanges which hold a coil is set in advance on the basis of the wire diameter, the number of turns of the wire, the wire diameter tolerance range, the coil bobbin tolerance range, and the like. The specifications of a coil to be molded can be easily determined on the basis of the specifications (diameter and diameter tolerance range) of a wire for forming a coil and the number of turns of the wire. The minimum and maximum widths are calculated as the width between flanges which hold a coil in accordance with predetermined calculations, thus setting the allowable range of the width between flanges.

As described in detail above, the fourth embodiment of the present invention can provide a fixing device having a low-cost, high-precision induction heating coil by a simple arrangement.

FIFTH EMBODIMENT

Still another example of the arrangement of an induction heating portion will be explained.

Figure 24:
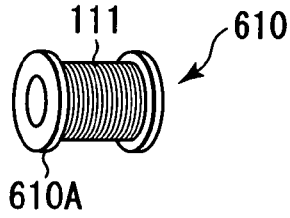
FIG. 24 is a perspective view showing an example of a coil unit.

FIG. 24 shows an example of the arrangement of a coil unit 610. The coil unit 610 is formed by a coil bobbin 610A whose outer surface is wound with a wire serving as a coil 111.

Figure 25:
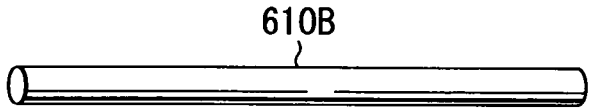
FIG. 25 is a perspective view showing an example of the holding member.

FIG. 25 shows the basic arrangement of a holding member 610B which holds the coil bobbin 610A.

Figure 26:
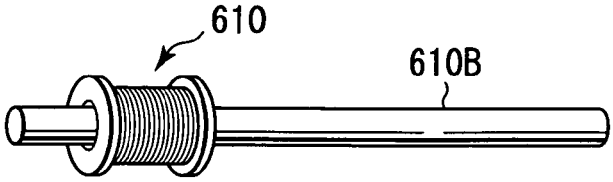
FIG. 26 is a perspective view showing a state in which the coil unit shown in FIG. 24 is held by the holding member shown in FIG. 25.

FIG. 26 shows a state in which the holding member 610B holds the coil unit 610. The holding member 610B is comprised of a plurality of coil units 610 (e.g., six or 12 coil units 610).

Figure 27:
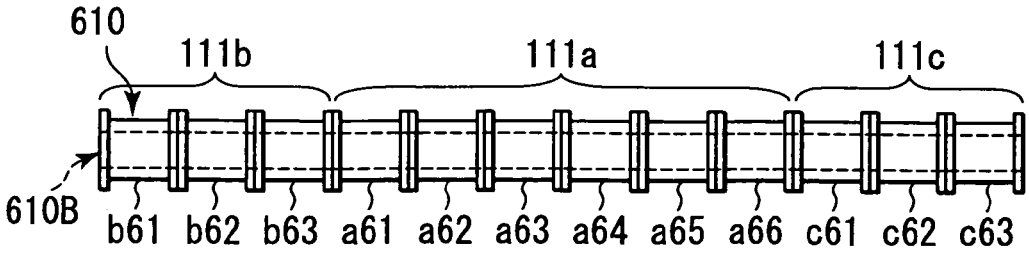
FIG. 27 is a plan view showing an example of the induction heating portion as the seventh arrangement example.

FIG. 27 shows an example of an induction heating portion stored in a heating roller 101, and illustrates the seventh arrangement example using 12 induction heating coil units 610. In the example of FIG. 27, three left coil units 610 (b61 to b63) in FIG. 27 form a coil 111*b* shown in FIG. 4 on the holding member 610B. Subsequent six coil units 610 (a61 to a66) form a coil 111*a* shown in FIG. 4, and subsequent three coil units 610 (c61 to c63) form a coil 111*c* shown in FIG. 4.

The coil units 610 can be coupled in the above-described fashion to constitute a plurality of coils (111*a*, 111*b*, and 111*c*). The coils of the coil units 610 are series- or parallel-connected to constitute the above-mentioned coils 111*a*, 111*b*, and 111*c*.

The coil unit 610 according to the present invention uses as a coil a wire which is made of copper and has a wire diameter of about 1 mm to 0.5 mm for a single wire. The coil unit 610 is driven at a high frequency of 2 MHz.

The eighth arrangement example of the above arrangement will be explained.

Figure 28:
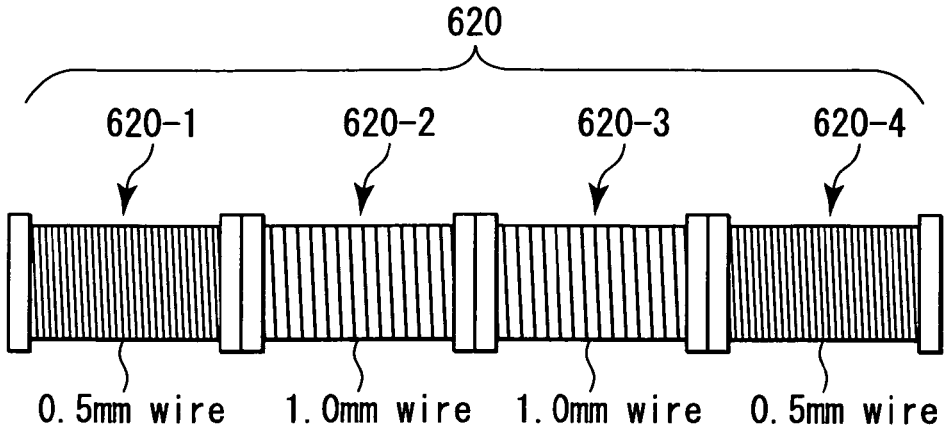
FIG. 28 is a plan view showing an example of the induction heating portion as the eighth arrangement example.

FIG. 28 shows the eighth arrangement example of the induction heating portion (induction heating coil). An induction heating portion 620 stored in the heating roller 101 uses four induction heating coil units. The induction heating portion 620 is constituted from the left in FIG. 28 by a coil wound around a coil unit 620-1 with a wire diameter (outer wire diameter) of 0.5 mm, a coil wound around a coil unit 620-2 with a wire diameter (outer wire diameter) of 1.0 mm, a coil wound around a coil unit 620-3 with a wire diameter (outer wire diameter) of 1.0 mm, and a coil wound around a coil unit 620-4 with a wire diameter (outer wire diameter) of 0.5 mm.

That is, the induction heating portion 620 is formed by a combination of coil units having a coil wire diameter of 0.5 mm and coil units having a coil wire diameter of 1.0 mm. The wire length can be changed even with the same unit width of the coil unit because of different wire diameters.

As described above, according to the eighth arrangement example, the induction heating-coil stored in the heating roller 101 is constituted by a combination of a plurality of types of coil units wound at a plurality of wire diameters. This can change the wire length with the same unit width.

The ninth arrangement example will be explained.

Figure 29:
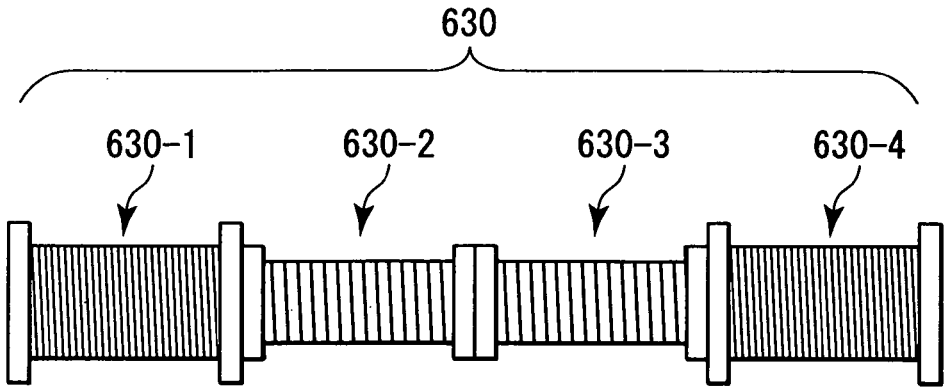
FIG. 29 is a plan view showing an example of the induction heating portion as the ninth arrangement example.

FIG. 29 shows the ninth arrangement example of the induction heating portion. An induction heating portion 630 stored in the heating roller 101 uses four coil units. The induction heating portion 630 is constituted by coil units 630-1, 630-2, 630-3, and 630-4 from the left in FIG. 29. The coil units 603-1 and 630-4, and the coil units 630-2 and 630-3 have different wire diameters of wound coils.

Figure 30:
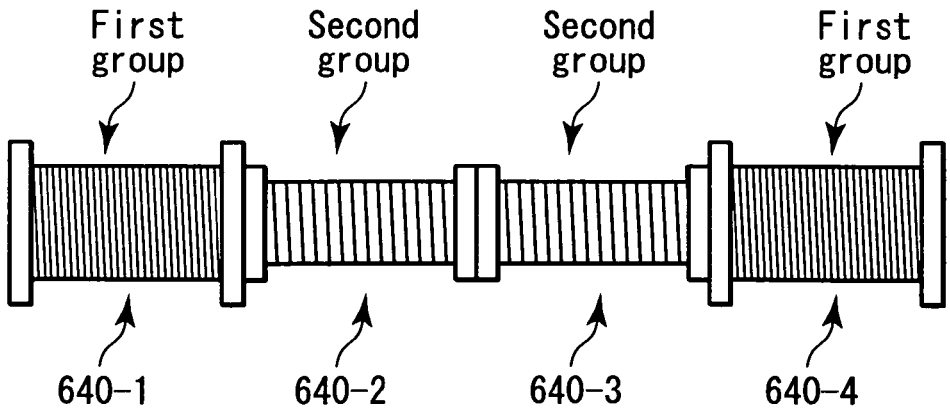
FIG. 30 is a plan view showing another example of the induction heating portion as the ninth arrangement example.

FIG. 30 shows an example in which a plurality of coils on a plurality of coil units are series- or parallel-connected to form the first and coil groups.

More specifically, coil units 640-1 and 640-4 have coils with the same wire diameter, and are so connected as to form the first coil group (first group). Coil units 640-2 and 640-3 have coils with the same wire diameter, and are so connected as to form the second coil group (second group).

As described above, each coil group is formed by coils with the same wire diameter, and coil groups have at least a plurality of wire diameters.

At least each of the first and second coil groups or a larger number of coil groups is comprised of coils with the same wire diameter, and coil groups have at least a plurality of wire diameters.

The heating roller 101 is supported at two ends, and the temperature loss occurs at the two ends. For temperature correction, the coil wire diameters of coil units at the two ends of the heating roller 101 may be changed from that at the center.

The heating roller 101 comprises a driving motor and its driving mechanism (neither is shown) at one end. The coil wire diameter of a coil unit at one end may be changed from that at the other end for temperature correction.

As described above, according to the ninth arrangement example, the induction heating coil stored in the heating roller 101 is formed by combining a plurality of types of coil units wound at a plurality of wire diameters, thereby effectively constituting a coil group. For example, the temperature loss at two or one end of the heating roller can be corrected.

The 10th arrangement example will be described.

Figure 31:
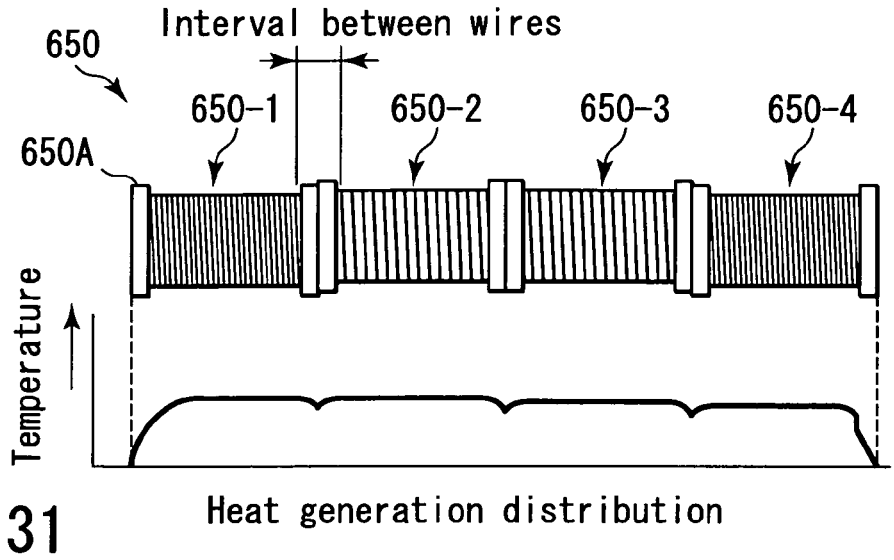
FIG. 31 is a plan view showing an example of the induction heating portion as the 10th arrangement example.

FIG. 31 shows the 10th arrangement example of the induction heating portion. An induction heating portion 650 stored in the heating roller 101 represents an arrangement example using four induction heating coil units. The induction heating portion 650 comprises from the left in FIG. 31 a coil wound around a coil bobbin 650A of a coil unit 650-1, a coil wound around the coil bobbin 650A of a coil unit 650-2, a coil wound around the coil bobbin 650A of a coil unit 650-3, and a coil wound around the coil bobbin 650A of a coil unit 650-4.

As described above, when the coil bobbins 650A are coupled or arrayed, the interval (distance isolated by flanges) between wires formed on adjacent coil bobbins is determined by setting each flange width to ½ or more of the wire diameter. In other words, left and right flanges correspond to the wire diameter (½×2) or more. This setting can avoid heat generation nonuniformity of the heating roller 101 depending on the distance (distance isolated by flanges) between wires.

The interval (distance isolated by flanges) between wires formed on adjacent coil bobbins may be changed depending on the location. For example, the wire interval is changed depending on the location in consideration of the balance of the size of a paper sheet fed to the heating roller 101.

As described above, according to the 10th arrangement example, the interval (distance isolated by flanges) between wires formed on adjacent coil bobbins is defined by setting the flange width to ½ or more of the wire diameter. Heat generation nonuniformity of the heating roller can be avoided.

Note that the present invention is not limited to the above embodiments, and can be variously modified without departing from the spirit and scope of the invention in practical use. The respective embodiments can be combined as properly as possible. In this case, the effects of the combination can be obtained. The embodiments include inventions on various stages, and various inventions can be extracted by an appropriate combination of building components disclosed.

For example, even when several building components are omitted from all those described in the embodiments, an arrangement from which these building components are omitted can be extracted as an invention as far as (at least one of) problems described in Description of the Related Art can be solved and (at least one of) effects described in BRIEF SUMMARY OF THE INVENTION can be obtained.

SIXTH EMBODIMENT

Figure 32:
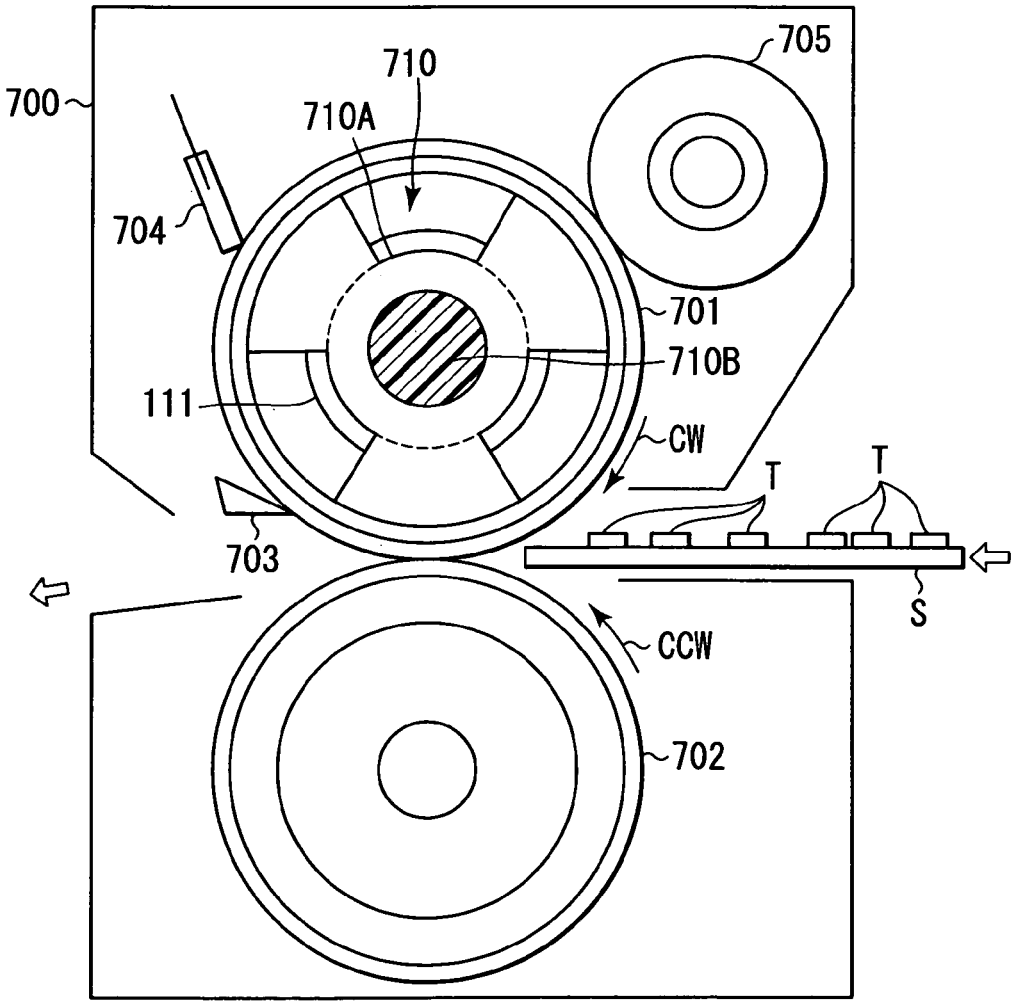
FIG. 32 is a schematic view showing still another example of the fixing device to which the embodiment of the present invention can be applied.

FIG. 32 shows another example of a fixing device which can be mounted in an image forming apparatus shown in FIG. 1.

A fixing device 700 comprises a heating roller 701 which can come into contact with a surface of a copying sheet S bearing toner and heats toner T and the copying sheet S, and a press roller 702 which applies a predetermined pressure to the heating roller 701. The contact between the heating roller 701 and the press roller 702 provides an elastic deformation region called a nip width.

The heating roller 701 is constituted by applying a fluoroplastic such as a tetrafluoroethylene resin to the outer surface of a roller body prepared by forming a conductive material such as iron into a cylindrical shape. The heating roller 701 is rotated in a direction indicated by an arrow (in this example, a direction CW) by a driving motor (not shown). The press roller 702 rotates in a direction indicated by an arrow (in this example, a direction CCW) in contact with the heating roller 701.

A copying sheet S guided to the contact between the heating roller 701 and the press roller 702 receives heat from the heating roller 701. The developer image T on the copying sheet S is fused and fixed onto the copying sheet S by the pressure of the press roller 702.

The heating roller 701 is surrounded by a separation claw 703 for separating the copying sheet S from the heating roller 701, a cleaning member 704 for removing toner, paper dust, and the like from the heating roller 701, and a coating roller 705 for coating the surface of the heating roller 701 with a mold release agent.

The heating roller 701 incorporates an induction heating coil unit 710. The coil unit 710 has a coil bobbin 710A whose outer surface is wound with a wire serving as a coil 111 (which may include coils 111*a*, 111*b*, and 111*c* shown in FIG. 4), and a holding member 710B which holds the coil bobbin 710A. When the coil 111 is formed by a plurality of coils 111*a*, 111*b*, and 111*c*, the coil bobbin 710A is formed by a plurality of coil bobbins 710A (710Aa, . . . ) in correspondence with the number of coils. Each coil of the coil unit 710 receives high-frequency power from a circuit shown in FIG. 4, and generates a high-frequency magnetic field for induction heating. The high-frequency magnetic field generates an eddy current in the heating roller 701, and Joule heat by the eddy current generates predetermined heat from the heating roller 701. An example of the coil unit which can be used in the fixing device 700 described with reference to FIG. 32 will be explained with reference to FIGS. 33 and 39 to 42.

Figure 33:
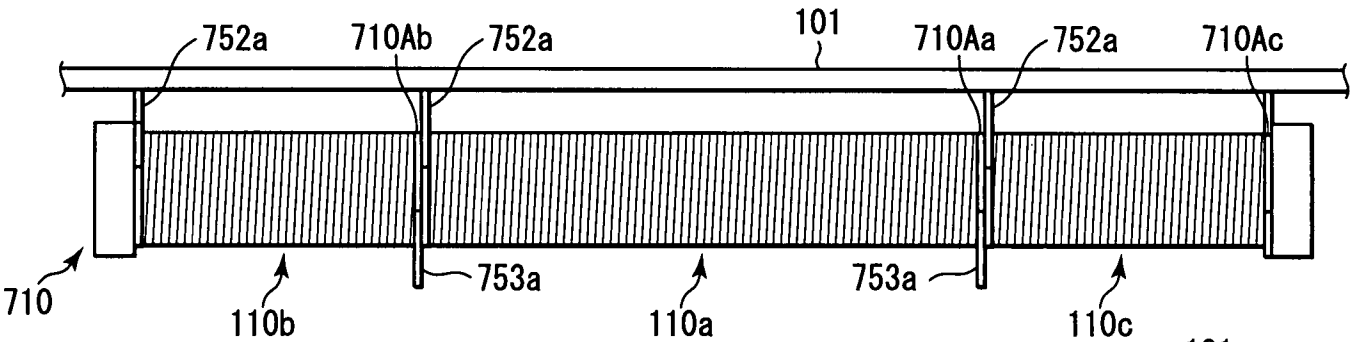
FIG. 33 is a plan view showing still another example of the induction heating portion.
Figure 34:
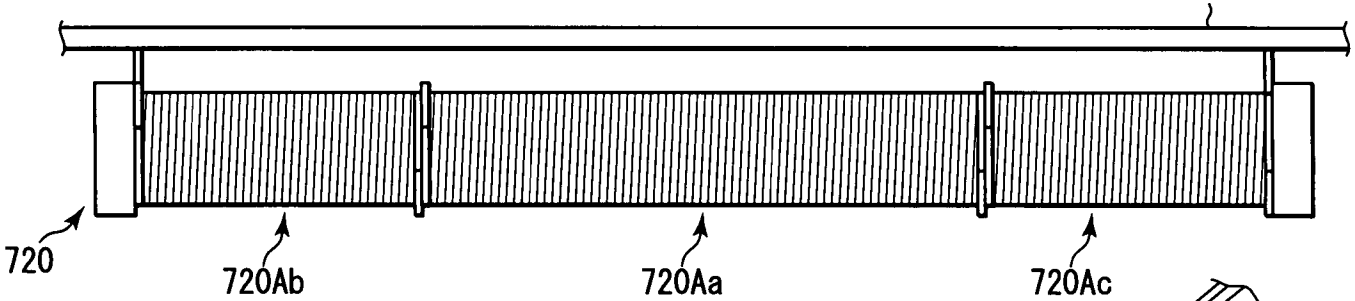
FIG. 34 is a plan view showing still another example of the induction heating portion.

As shown in FIG. 33, the coil unit 710 has the first coil 111*a* prepared by winding a wire with a predetermined sectional area around the coil bobbin 710Aa, and the second coils 111*b* and 111*c* prepared by winding wires with a predetermined sectional area around the coil bobbins 710Ab and 710Ac. The coils 111*a*, 111*b*, and 111*c* are held by a holding member (not shown in FIG. 33) in a predetermined array as described with reference to FIG. 4.

The first-coil 111*a* and the second coils 111*b* and 111*c* employ a coil bobbin 750 described with reference to FIG. 39.

Figure 39:
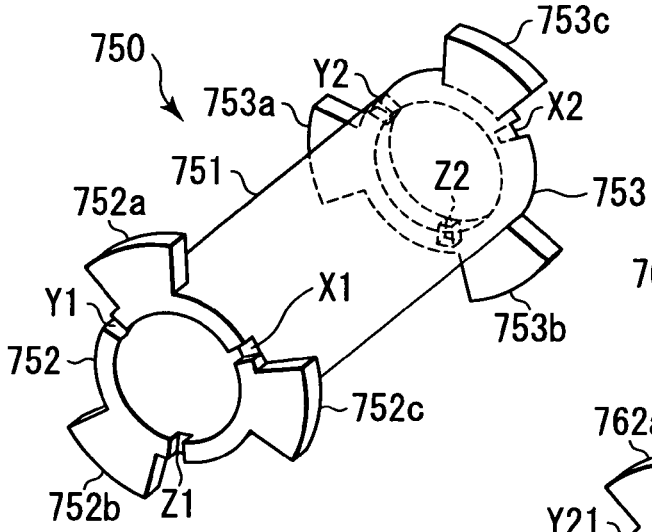
FIG. 39 is a perspective view showing still another example of the coil bobbin.

As shown in FIG. 39, the coil bobbin 750 has a hollow cylindrical shape with an outer surface formed with a radius R11 from the central shaft and a hollow (no reference numeral). The coil bobbin 750 has a coil region 751 where the wire is wound on the outer surface, and edges 752 and 753 formed at the two ends of the coil region 751. Wiring portions X1, Y1, and Z1 and wiring portions X2, Y2, and Z2 used to guide a wire wound in the coil region 751 into the hollow in the coil bobbin 750 are formed at predetermined positions of the edges 752 and 753.

Figure 41:
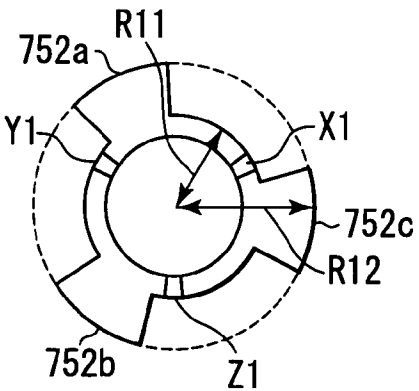
FIG. 41 is a plan view showing part of the coil bobbin shown in FIG. 39.
Figure 42:
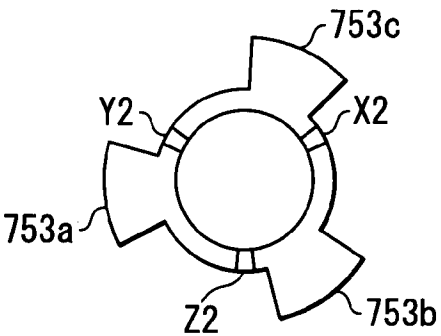
FIG. 42 is a plan view showing part of the coil bobbin shown in FIG. 39.

The edges 752 and 753 formed at the two ends of the coil region 751 are equipped with flanges 752*a*, 752*b*, and 752*c* and flanges 753*a*, 753*b*, and 753*c* which are given shapes as shown in FIGS. 41 and 42 and can prevent removal of a wire wound in the coil region 751 in the longitudinal direction of the coil.

As shown in FIG. 33, the flanges 752*a*, 752*b*, 752*c*, 753*a*, 753*b*, and 753*c* can come into contact with the inner surface of the heating roller 701 to maintain the interval between the heating roller 701 and the coil 111 at a predetermined distance. In other words, a height R12 of the flanges 752*a*, 752*b*, 752*c*, 753*a*, 753*b*, and 753*c* is adjusted to one defined by the radius corresponding to the diameter of a wire wound around the outer surface of the coil bobbin 750 and the interval from the heating roller 701.

The flanges 752*a*, 752*b*, and 752*c* and the flange 753*a*, 753*b*, and 753*c* are arranged at almost equal intervals at the peripheries of the coil bobbin 750. As is apparent from FIGS. 41 and 42, the flange 752 (a, b, and c) and the flange 753 (a, b, and c) are so formed as to shift by a predetermined amount the phase which passes through the central axis within a plane perpendicular to an axis defined as the center (not shown) of the coil bobbin 750 when an arbitrary point on the periphery of the bobbin 750 is regarded as an origin. The size and presence/absence of the phase shift can be arbitrarily set.

The coil bobbin 750 may comprise a projection (to be described later) on the inner surface in the hollow. The projection has a function of suppressing circumferential rotation of the coil bobbin 750 when the coil bobbin 750 is held by the holding member 710B.

The coil unit 710 holds a plurality of (three in this example) coil bobbins 750 in a layout in which the wiring portions X1 and X2, Y1 and Y2, and Z1 and Z2 face each other.

The coils 111*a*, 111*b*, and 111*c* of the coil unit 710 can maintain a predetermined distance from the heating roller 701 by the flanges 752*a*, 752*b*, and 752*c* and the flanges 753*a*, 753*b*, and 753*c* which are arranged at two ends at almost equal intervals. At a location where the three coil bobbins 750 are adjacent to each other, at least one of the flanges 752*a*, 752*b*, 752*c*, 753*a*, 753*b*, and 753*c* of each coil bobbin comes into contact with the inner surface of the heating roller 701. Even when a belt-like heating member replaces a coil unit or roller member elongated in the longitudinal direction, the distance between the coil and the heating member can be kept constant.

Figure 40:
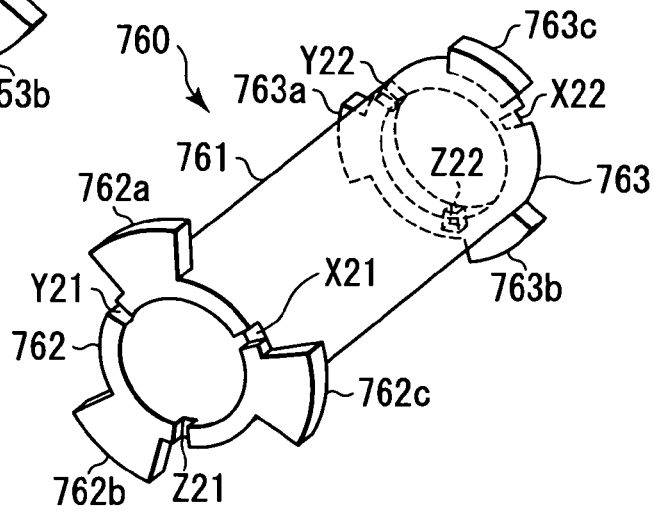
FIG. 40 is a perspective view showing still another example of the coil bobbin.

The same effects can also be obtained when a coil bobbin 760 as shown in FIG. 40 having a flange formed at only one of edges 762 and 763 replaces the coil bobbin 750.

Figure 35:
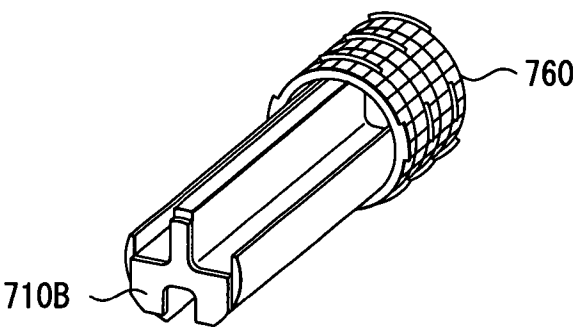
FIG. 35 is a perspective view showing another example of the holding member.
Figure 36:
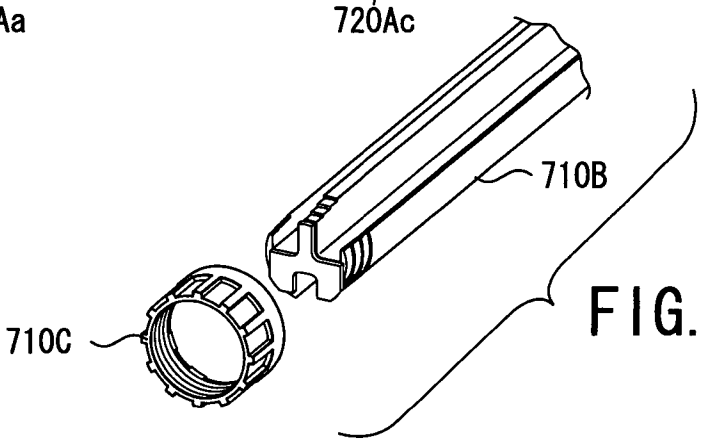
FIG. 36 is a perspective view showing an example of a stopper.

At this time, the coil bobbin 760 is held by the holding member 710B, as shown in FIG. 35, and prevented by a stopper 710C from moving in the longitudinal direction of the holding member 710B, as shown in FIG. 36.

The same effects can also be obtained using a coil unit in which coil bobbins 720Ab and 720Ac have flanges on ends which do not contact a coil bobbin 720Aa.

Another example of the coil unit which can be used in the fixing device described with reference to FIG. 32 will be explained with reference to FIGS. 37 and 43 to 46.

Figure 37:
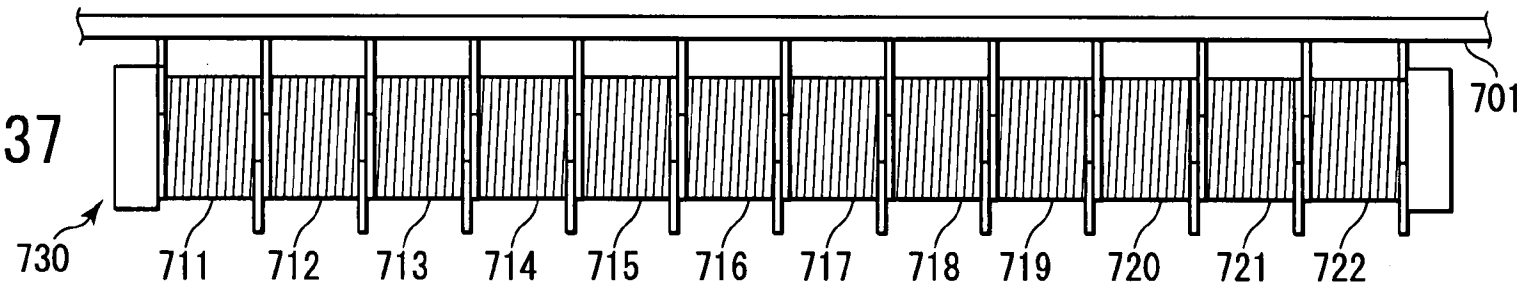
FIG. 37 is a plan view showing still another example of the induction heating portion.

As shown in FIG. 37, a coil unit 730 has coils 711 to 722 each prepared by winding a wire with a predetermined sectional area around a coil bobbin 770 (to be described later with reference to FIG. 43).

Figure 43:
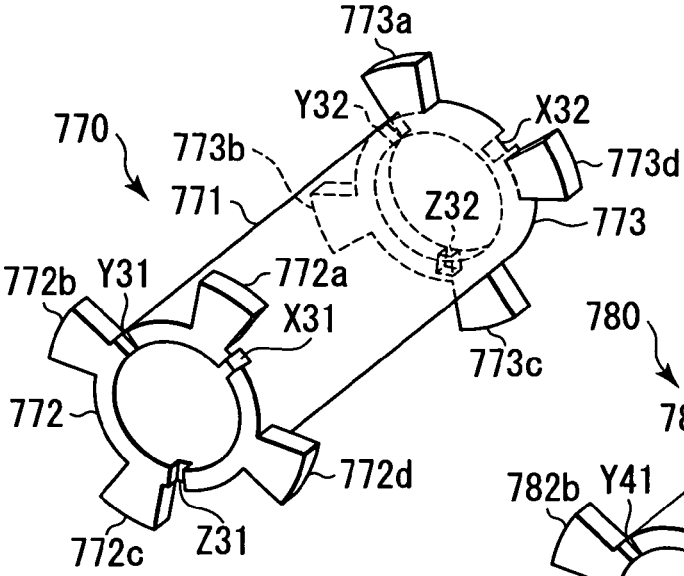
FIG. 43 is a perspective view showing still another example of the coil bobbin.

As shown in FIG. 43, the coil bobbin 770 has a hollow cylindrical shape with an outer surface formed with a radius R21 from the central shaft and a hollow (not shown). The coil bobbin 770 has a coil region 771 where the wire is wound on the outer surface, and edges 772 and 773 formed at the two ends of the coil region 771. Wiring portions X31, Y31, and Z31 and wiring portions X32, Y32, and Z32 used to guide a wire wound in the coil region 771 into the hollow in the coil bobbin 770 are formed at predetermined positions of the edges 772 and 773.

Figure 45:
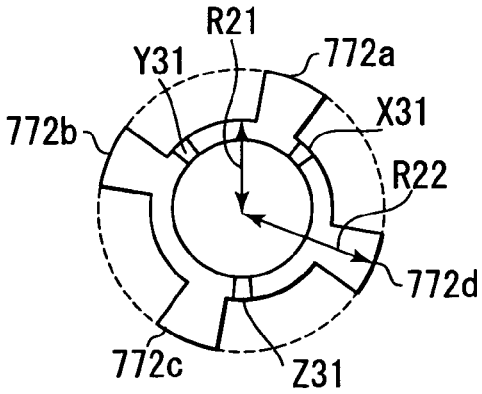
FIG. 45 is a plan view showing part of the coil bobbin shown in FIG. 43.
Figure 46:
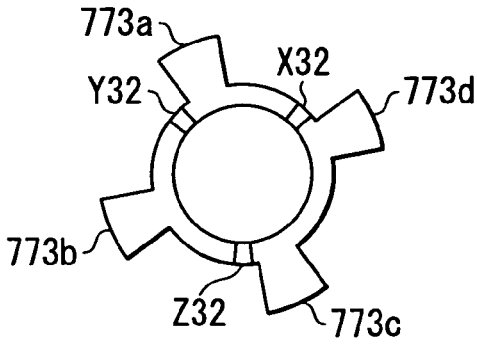
FIG. 46 is a plan view showing part of the coil bobbin shown in FIG. 43.

The edges 772 and 773 formed at the two ends of the coil region 771 are equipped with flanges 772*a*, 772*b*, 772*c*, and 772*d* and flanges 773*a*, 773*b*, 773*c*, and 773*d* which are given shapes as shown in FIGS. 45 and 46 and can prevent removal of a wire wound in the coil region 771 in the longitudinal direction of the coil.

As shown in FIG. 37, the flanges 772*a*, 772*b*, 772*c*, 772*d*, 773*a*, 773*b*, 773*c*, and 773*d* can come into contact with the inner surface of the heating roller 701 to maintain the interval between the heating roller 701 and the coils 711 to 722 at a predetermined distance. In other words, a height R22 of the flanges 772*a*, 772*b*, 772*c*, 772*d*, 773*a*, 773*b*, 773*c*, and 773*d* is adjusted to one defined by the radius corresponding to the diameter of a wire wound around the outer surface of the coil bobbin 770 and the interval from the heating roller 701.

The flanges 772*a*, 772*b*, 772*c*, and 772*d* and the flange 773*a*, 773*b*, 773*c*, and 773*d* are arranged at almost equal intervals at the peripheries of the coil bobbin 770. As is apparent from FIGS. 45 and 46, the flange 772 (a, b, c, and d) and the flange 773 (a, b, c, and d) are so formed as to shift by a predetermined amount the phase which passes through the central axis within a plane perpendicular to an axis defined as the center (not shown) of the coil bobbin 770 when an arbitrary point on the periphery of the bobbin 770 is regarded as an origin. The size and presence/absence of the phase shift can be arbitrarily set.

The coil bobbin 770 may comprise a projection (to be described later) on the inner surface in the hollow. The projection has a function of suppressing circumferential rotation of the coil bobbin 770 when the coil bobbin 770 is held by the holding member 710B.

The coil unit 730 holds a plurality of (12 in this example) coil bobbins 770 in a layout in which the wiring portions X31 and X32, Y31 and Y32, and Z31 and Z32 face each other.

The coils 711 to 722 of the coil unit 730 can maintain a predetermined distance from the heating roller 701 by the flanges 772*a*, 772*b*, 772*c*, and 772*d* and the flanges 773*a*, 773*b*, 773*c*, and 773*d* which are arranged at two ends at almost equal intervals. At a location where the 12 coil bobbins 770 are adjacent to each other, at least one of the flanges 772*a*, 772*b*, 772*c*, 772*d*, 773*a*, 773*b*, 773*c*, and 773*d* of each coil bobbin comes into contact with the inner surface of the heating roller 701. Even when a belt-like heating member replaces a coil unit or roller member elongated in the longitudinal direction, the distance between the coil and the heating member can be kept constant.

Figure 38:
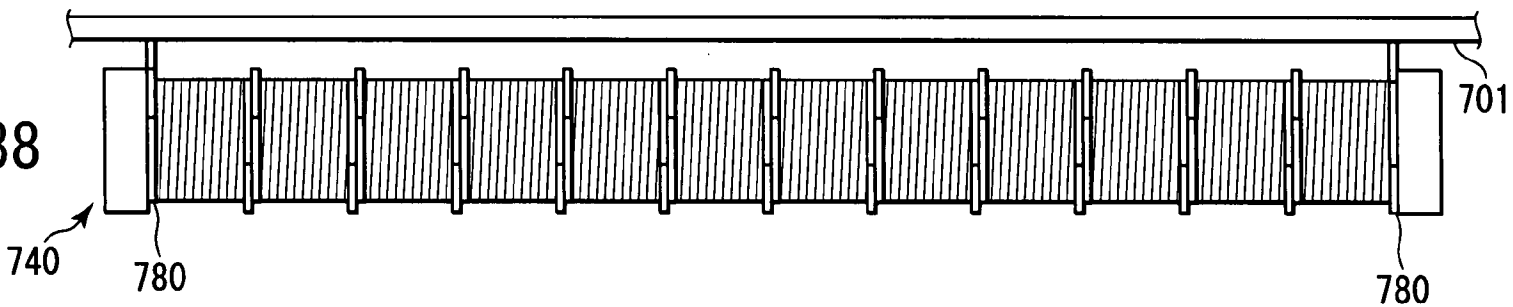
FIG. 38 is a plan view showing still another example of the induction heating portion.
Figure 44:
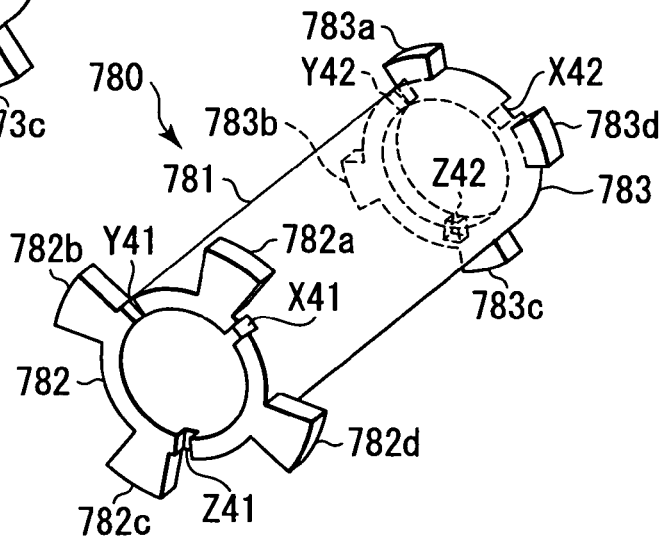
FIG. 44 is a perspective view showing still another example of the coil bobbin.

The same effects can also be obtained when a coil bobbin 780 as shown in FIG. 44 having a flange formed at only one of edges 782 and 783 replaces the coil bobbin 770. For example, a coil bobbin 740 shown in FIG. 38 comprises the coil bobbins 780 at two ends.

Figure 47:
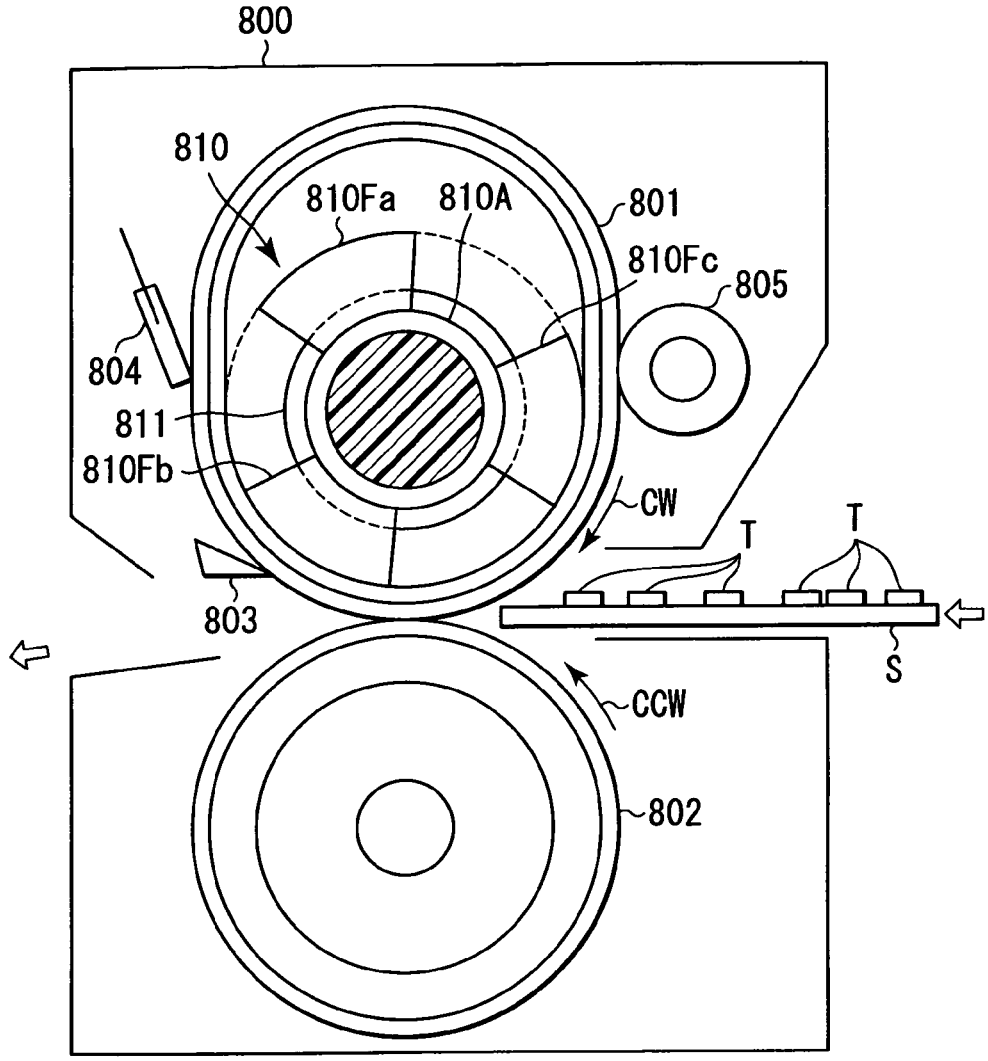
FIG. 47 is a schematic view showing still another example of the fixing device to which the embodiment of the present invention can be applied.

FIG. 47 shows still another example of the fixing device which can be mounted in an image forming apparatus shown in FIG. 1.

In FIG. 47, a fixing device 800 comprises a heating member 801 which can come into contact with a surface of a copying sheet S bearing toner and heats toner T and the copying sheet S, and a press roller 802 which applies a predetermined pressure to the heating member 801. The contact between the heating member 801 and the press roller 802 provides an elastic deformation region called a nip width. The contact between the heating member 801 and the press roller 802 may be flat with a predetermined nip width in a direction in which the heating member 801 is moved to a predetermined position. In the fixing device 800, the press roller 802 may dent into a predetermined portion of the heating member 801 and contact the heating member 801.

The heating member 801 is an endless belt which is formed into a cylindrical shape with a predetermined circumference by using a conductive material such as nickel, stainless steel, copper, aluminum, an alloy of stainless steel and aluminum, or iron. The heating member 801 has a predetermined hardness, and is maintained in a predetermined shape by external force. The heating member 801 is constituted by applying a fluoroplastic such as a tetrafluoroethylene resin to the outer surface of the conductive member. Also, an elastic layer of silicone rubber, fluororubber, or the like, and a separation layer of PFA (polyformaldehyde=heat-resistant resin) or the like are formed on the outer surface of the heating member 801. A sliding layer of PFA (polyformaldehyde=heat-resistant resin) or the like is formed on the inner surface of the heating member 801. Alternatively, oil is applied from an oil coating mechanism (not shown) to the inner surface of the heating member 801. Thus, the belt of the conductive material can move smoothly.

The heating member 801 is surrounded by a separation claw 803 for separating the copying sheet S from the heating member 801, a cleaning member 804 for removing toner, paper dust, and the like from the heating member 801, and a coating roller 805 for coating the surface of the heating member 801 with a mold release agent.

The heating member 801 incorporates an induction heating coil unit 810. The coil unit 810 has a coil 811 formed by winding a wire with a predetermined sectional area around a coil bobbin 810A, and a holding member 810B which holds the coil bobbin 810A.

Flanges 810Fa, 810Fb, and 810Fc capable of preventing removal of a wire wound around the outer surface in the longitudinal direction of the coil are formed at the two ends of the coil bobbin 810A in the longitudinal direction of the coil. In other words, the height of the flanges 810Fa, 810Fb, and 810Fc is adjusted to one defined by the radius corresponding to the diameter of a wire wound around the outer surface of the coil bobbin 810A and the interval from the heating member 801.

When the coil 811 is formed by a plurality of coils, the coil bobbin 810A may be formed by a plurality of coil bobbins 810A (810A1, . . . ) in correspondence with the number of coils.

The press roller 802 is rotated in a direction indicated by an arrow (in this example, a direction CCW) by a driving motor (not shown) or the like. The heating member 801 is rotated in a direction indicated by an arrow (in this example, a direction CW) in contact with the press roller 802.

A copying sheet S guided to the contact between the heating member 801 and the press roller 802 receives heat from the heating member 801. The developer image T on the copying sheet S is fused and fixed onto the copying sheet S by the pressure of the press roller 802.

The coil unit 810 receives high-frequency power from a circuit shown in FIG. 4, and generates a high-frequency magnetic field for induction heating. Joule heat by an eddy current generated by the high-frequency magnetic field generates predetermined heat from the heating member 801.

Also when the coil bobbin 750 or 760 shown in FIG. 39 or 40 or the coil bobbin 770 or 780 having four flanges as shown in FIG. 43 or 44 is used instead of the coil bobbin 810, the same effects can be obtained.

As described above, according to the sixth embodiment of the present invention, flanges which guide a heating member for generating heat by Joule heat by an eddy current generated by a magnetic field are integrated at predetermined positions of the coil unit which generates a predetermined magnetic field in a heating device utilizing induction heating. The sixth embodiment can facilitate assembly operation (work) of the heating device.

What is claimed is:

1. A fixing device comprising:

induction heating means having coil bobbins each wound with a wire which forms a coil, and a holding member which holds the plurality of coil bobbins at predetermined positions; and a target heating member which generates heat with an eddy current generated upon a change in a magnetic field generated by the coil of the induction heating means, wherein the holding member is shaped by compression molding and is fitted in an inner shape of each of the coil bobbins, and each coil bobbin is molded by injection molding.

2. A device according to claim 1, wherein on the coil bobbin, the interval between coils wound around adjacent coil bobbins in the state in which the coil bobbin is held by the holding member is so set as to adjust to not more than a predetermined value a temperature on the target heating member heated by the coils.

3. A device according to claim 1, wherein the coil bobbin has guides which regulate two ends of the coil, and a width between the guides is so set as to hold at a predetermined interval the interval between coils wound around adjacent coil bobbins in the state in which the coil bobbin is held by the holding member.

4. A device according to claim 1, wherein the coil bobbins have projections which adjust an interval between coils, on adjacent surfaces of adjacent coil bobbins in the state in which the coil bobbin is held by the holding member.

5. A device according to claim 1, wherein the coil bobbin and the holding member are formed using the same material.

6. A device according to claim 1, wherein the coil bobbin and the holding member are molded using materials having thermal expansion coefficients whose difference falls within a predetermined allowable range.

7. A device according to claim 1, wherein the coil bobbin is formed into a hollow cylinder, and at least one coil bobbin out of the plurality of coil bobbins has an outer diameter different from an outer diameter of the remaining coil bobbins.

8. A device according to claim 1, wherein at least one coil bobbin out of the plurality of coil bobbins has the number of turns different from the number of turns of the remaining coil bobbins.

9. A device according to claim 7, wherein coils wound around at least two coil bobbins having different outer diameters are connected to constitute one circuit.

10. A device according to claim 8, wherein coils wound around at least two coil bobbins having the same number of coil turns out of the coil bobbins are connected to constitute one circuit.

11. A device according to claim 3, wherein the guides are respectively arranged at the two ends of the coil holding member, and the width between the guides is set to not less than a value obtained by multiplying a sum of a diameter of the wire and an error range of the diameter of the wire by a sum of the number of turns of the wire and one.

12. A device according to claim 3, wherein the coil is formed by a single wire covered with an insulating member, and the guides are so set as to adjust a distance between facing outermost coils of two adjacent coil bobbins to not less than ½ of a diameter of the single wire.

13. A device according to claim 3, wherein guides of adjacent coil bobbins are so constituted as to be arranged at positions different from each other.

14. A device according to claim 13, wherein the guides arranged at the different positions prevent a coil wound around a coil bobbin from coming into contact with a coil wound around another coil bobbin.

15. A fixing device comprising:

an induction heating member which has coil bobbins each wound with a wire that forms a coil and a holding member that holds the plurality of coil bobbins at predetermined positions; and a target heating member which generates heat with an eddy current generated upon a change in a magnetic field generated by the coil of the induction heating member, wherein each of the coil bobbins has a hollow cylindrical shape and includes guides that are respectively provided at two ends of each of the coil bobbins, and the guides of one of any adjacent two of the coil bobbins are displaced from the guides of the other in a circumferential direction of the coil bobbins.

16. A device according to claim 15, wherein the coil is formed by a single wire covered with an insulating member.

17. A device according to claim 16, wherein a width of each of the guides of each coil bobbin is equal to or less than half a diameter of the single wire.

18. A fixing device comprising:

an induction heating member which has coil bobbins each wound with a single wire that forms a coil and a holding member that holds the plurality of coil bobbins at predetermined positions; and a target heating member which generates heat with an eddy current generated upon a change in a magnetic field generated by the coil of the induction heating member, wherein each of the coil bobbins has a hollow cylindrical shape and includes guides that are respectively provided at two ends of each coil bobbin, and a width of each of the guides of each coil bobbin is equal to or less than half a diameter of the single wire.

* * * * *